US009424778B2

(12) United States Patent
Fujii et al.

(10) Patent No.: US 9,424,778 B2
(45) Date of Patent: Aug. 23, 2016

(54) DRIVE CIRCUIT, DRIVING METHOD, DISPLAY UNIT, AND ELECTRONIC APPARATUS

(71) Applicant: JOLED Inc., Tokyo (JP)

(72) Inventors: Takuma Fujii, Aichi (JP); Masatsugu Tomida, Aichi (JP); Mitsuru Asano, Kanagawa (JP)

(73) Assignee: JOLED Inc., Tokyo (JP)

( * ) Notice: Subject to any disclaimer, the term of this patent is extended or adjusted under 35 U.S.C. 154(b) by 46 days.

(21) Appl. No.: 14/346,900

(22) PCT Filed: Oct. 9, 2012

(86) PCT No.: PCT/JP2012/076118
§ 371 (c)(1),
(2) Date: Mar. 24, 2014

(87) PCT Pub. No.: WO2013/061767
PCT Pub. Date: May 2, 2013

(65) Prior Publication Data

US 2014/0232705 A1 Aug. 21, 2014

(30) Foreign Application Priority Data

Oct. 26, 2011 (JP) ..... 2011-235045

(51) Int. Cl.
*G09G 3/32* (2016.01)

(52) U.S. Cl.
CPC ..... *G09G 3/3266* (2013.01); *G09G 3/3233* (2013.01); *G09G 3/3258* (2013.01); *G09G 3/3291* (2013.01); *G09G 2310/0251* (2013.01); *G09G 2320/02* (2013.01); *G09G 2320/04* (2013.01); *G09G 2320/045* (2013.01); *G09G 2330/10* (2013.01)

(58) Field of Classification Search
CPC ..... G09G 3/3266; G09G 3/3258; G09G 3/32; G09G 2310/0202; G09G 2310/0205; G09G 2310/0208; G09G 2310/021; G09G 2310/0213; G09G 2310/0267; G09G 3/3299; G09G 3/3233; G09G 2310/0251; G09G 2320/045; G09G 2320/04; G09G 2320/02; G09G 2330/10
See application file for complete search history.

(56) References Cited

U.S. PATENT DOCUMENTS 8,390,540 B2 * 3/2013 Yamamoto ..... G09G 3/3233 345/204
2009/0122053 A1 * 5/2009 Yamamoto et al. ..... 345/213
2009/0278834 A1 * 11/2009 Tomida et al. ..... 345/211

(Continued)

FOREIGN PATENT DOCUMENTS

JP 2005-258326 A 9/2005
JP 2005-326793 A 11/2005
JP 2007-133284 A 5/2007

(Continued)

*Primary Examiner* — Saiful A Siddiqui
(74) *Attorney, Agent, or Firm* — Michael Best and Friedrich

(57) ABSTRACT

A drive section driving a plurality of pixel circuits by line-sequential scanning is provided. On a plurality of the pixel circuits belonging to one horizontal line, the above-described drive section performs a first preparation drive based on a first voltage in a first preparation period, then performs a second preparation drive based on the first voltage in a second preparation period, and performs writing of luminance information in a subsequent writing period. The second preparation period ends at a timing out of the first preparation periods of other horizontal lines.

15 Claims, 21 Drawing Sheets

(56) References Cited

U.S. PATENT DOCUMENTS

2009/0284451 A1* 11/2009 Yamamoto et al. ..... 345/77
2011/0074838 A1* 3/2011 Yamamoto ..... G09G 3/3233 345/690

FOREIGN PATENT DOCUMENTS

JP 2008-033193 A 2/2008
JP 2009-139928 A 6/2009
JP 2009-251430 A 10/2009

* cited by examiner

DRIVE CIRCUIT, DRIVING METHOD, DISPLAY UNIT, AND ELECTRONIC APPARATUS

TECHNICAL FIELD

The present disclosure relates to a drive circuit that drives a light emitting device such as an organic EL, to a driving method, to a display unit that includes such a drive circuit, and to an electronic apparatus.

BACKGROUND ART

In recent years, in a field of display units that perform image display, there has been developed and commercialized a display unit (an organic EL display unit) that uses, as a light emitting device, a current-driven optical device in which light emission luminance varies in accordance with a value of a current passing therethrough, for example, an organic EL (Electro Luminescence) device. Unlike a device such as a liquid crystal device, the organic EL device is a self-emitting device, and it is not necessary to provide a light source (a backlight) therefor. Therefore, the organic EL display unit has characteristics such as high visibility of an image, low power consumption, and high response speed of device, compared to the liquid crystal display unit in which the light source is necessary.

As a driving scheme of the organic EL display unit, there are a simple (passive) matrix scheme and an active matrix scheme as with the liquid crystal display unit. The former has a simple structure; however, has an issue such as difficulty in achieving large and high-definition display unit. Therefore, currently, the latter active matrix scheme has been actively developed (for example, Patent Literature 1, etc.). In this scheme, a current that passes through an organic EL device arranged for each pixel is controlled by a transistor in a pixel circuit provided for each organic EL device.

CITATION LIST

Patent Literature

Patent Literature 1: Japanese Unexamined Patent Application Publication No. 2008-33193

SUMMARY OF THE INVENTION

By the way, in the display unit, defects such as a point defect (a dot defect) and a line defect may occur in some cases in manufacturing. Such defects such as the point defect and the line defect may be often noticeable for a user. A user who has purchased a display unit that has many defects as described above feels unfairness. Therefore, reduction in such defects is desired.

Accordingly, it is desirable to provide a drive circuit, a driving method, a display unit, and an electronic apparatus that are capable of reducing defects in display.

A drive circuit of an embodiment of the present technology includes a drive section driving a plurality of pixel circuits by line-sequential scanning. On a plurality of the pixel circuits belonging to one horizontal line, the above-described drive section performs a first preparation drive based on a first voltage in a first preparation period, then performs a second preparation drive based on the first voltage in a second preparation period, and performs writing of luminance information in a subsequent writing period. The second preparation period ends at a timing out of the first preparation periods of other horizontal lines.

A driving method of an embodiment of the present disclosure includes: at a time of driving a plurality of pixel circuits by line-sequential driving, on a plurality of the pixel circuits belonging to one horizontal line, performing a first preparation drive based on a first voltage in a first preparation period; then performing a second preparation drive based on the first voltage in a second preparation period, the second preparation period ending at a timing out of the first preparation periods of other horizontal lines; and performing writing of luminance information in a subsequent writing period.

A display unit of an embodiment of the present disclosure includes a plurality of pixel circuits, and a drive section driving the plurality of pixel circuits by line-sequential scanning. On a plurality of the pixel circuits belonging to one horizontal line, the above-described drive section performs a first preparation drive based on a first voltage in a first preparation period, then performs a second preparation drive based on the first voltage in a second preparation period, and performs writing of luminance information in a subsequent writing period. The second preparation period ends at a timing out of the first preparation periods of other horizontal lines.

An electronic apparatus of an embodiment of the present disclosure includes the above-described display unit. Examples thereof may include a television apparatus, a digital camera, a personal computer, a video camcorder, and a mobile terminal apparatus such as a mobile phone.

In the drive circuit, the driving method, the display unit, and the electronic apparatus according to some embodiments of the present disclosure, at the time of driving the plurality of pixel circuits, on the plurality of pixel circuits belonging to one horizontal line, the first preparation drive is performed based on the first voltage in the first preparation period, the second preparation drive is performed based on the first voltage in the subsequent second preparation period, and the writing of the luminance information is performed in the subsequent writing period. At that time, the second preparation period ends at the timing out of the first preparation periods of other horizontal lines.

According to the drive circuit, the driving method, the display unit, and the electronic apparatus according to some embodiments of the present disclosure, the second preparation period of one horizontal line ends at the timing out of the first preparation period of other horizontal lines. Therefore, it is possible to reduce defects in display.

MODES FOR CARRYING OUT THE INVENTION

Figure 1:
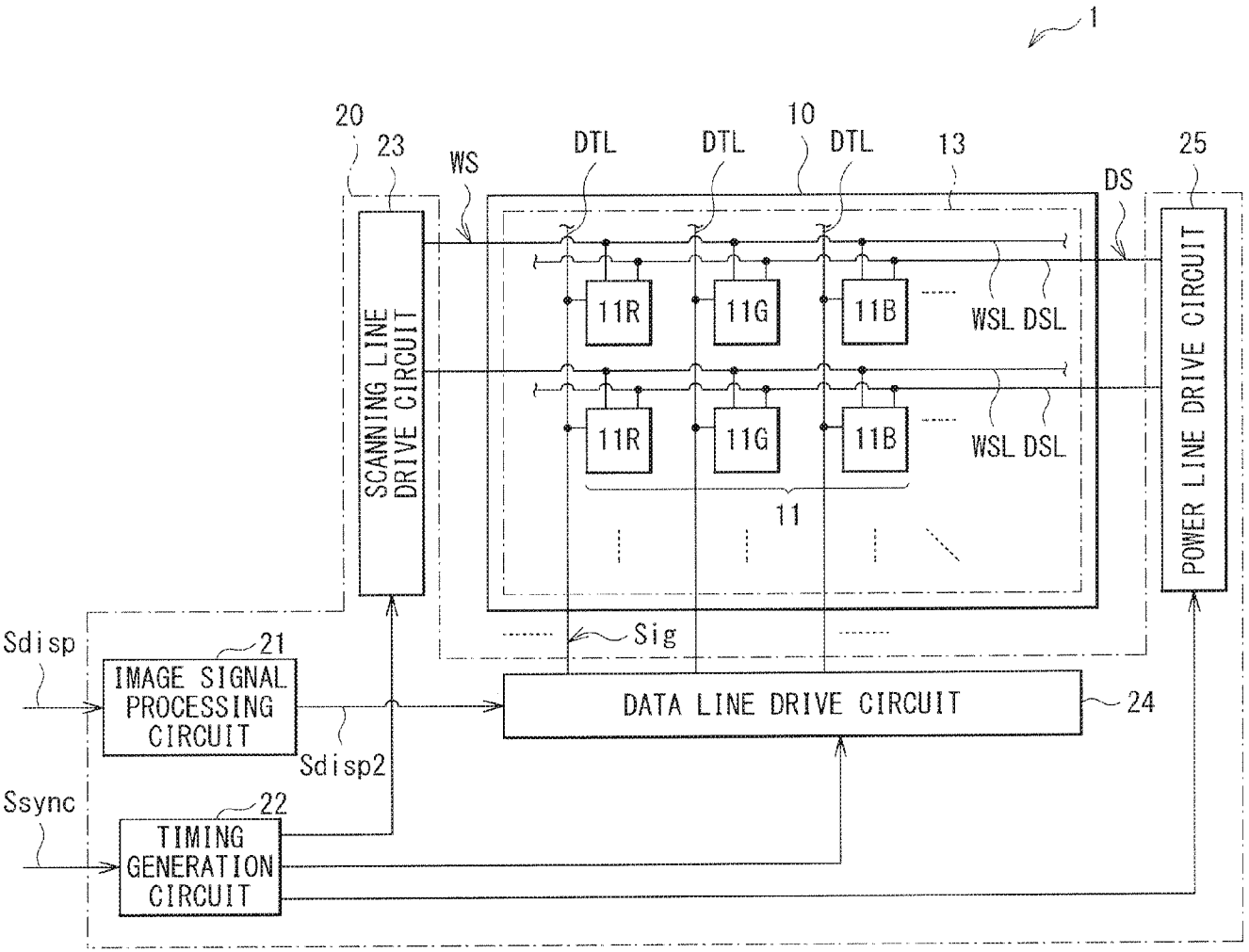
FIG. 1 is a block diagram illustrating a configuration example of a display unit according to a first embodiment of the present invention.

Some embodiments of the present disclosure will be described below in detail referring to the drawings. It is to be noted that the description will be given in the following order.

1. First Embodiment
2. Second Embodiment
3. Application Examples

1. First Embodiment

Configuration Example

FIG. 1 illustrates a configuration example of a display unit according to a first embodiment. A display unit 1 is a display unit of an active matrix scheme that uses an organic EL device. It is to be noted that a drive circuit and a driving method according to the embodiments of the present disclosure are embodied by the present embodiment, and therefore, will be explained together herein. This display unit 1 includes a display panel 10 and a drive circuit 20.

The display panel 10 includes a pixel array section 13, and performs pixel display by active matrix drive. In the pixel array section 13, a plurality of pixels 11 are arranged in a matrix. Here, each pixel 11 is configured of a pixel 11R for red, a pixel 11G for green, and a pixel 11B for blue. It is to be noted that, hereinafter, "pixel 11" is appropriately used collectively referring to the pixel 11R, the pixel 11G, and the pixel 11B.

The pixel array section 13 includes a plurality of scanning lines WSL, a plurality of power lines DSL, and a plurality of data lines DTL. The plurality of scanning lines WSL and the plurality of power lines DSL extend in a row direction. The plurality of data lines DTL extend in a column direction. One end of each of these scanning lines WSL, power lines DSL, and data lines DTL is connected to the drive circuit 20. Each of the above-described pixels 11 is arranged at an intersection of the scanning line WSL and the data line DTL.

Figure 2:
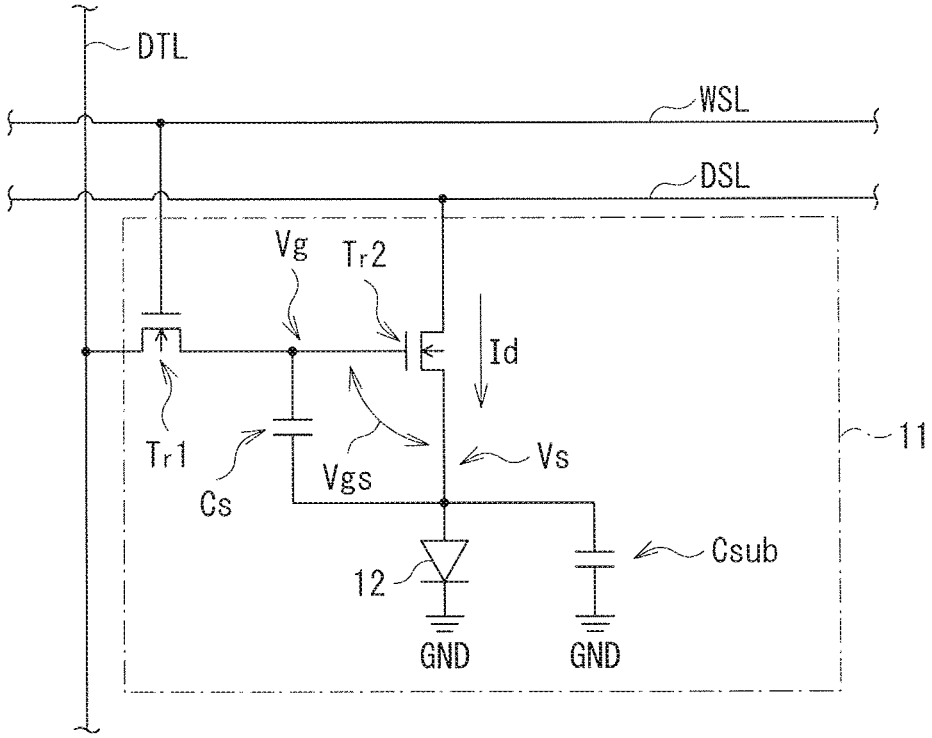
FIG. 2 is a circuit diagram illustrating a configuration example of each pixel shown in FIG. 1.

FIG. 2 illustrates an example of a circuit configuration of the pixel 11. The pixel 11 includes a writing transistor Tr1, a driving transistor Tr2, an organic EL device 12, and capacitors Cs and Csub. In other words, in this example, the pixel 11 is configured using the writing transistor Tr1, the driving transistor Tr2, and the capacitor Cs, and has a so-called "2Tr1C" configuration.

The writing transistor Tr1 and the driving transistor Tr2 may each be configured, for example, of a TFT (Thin Film Transistor) of an n-channel MOS (Metal Oxide Semiconductor) type. A gate of the writing transistor Tr1 is connected to the scanning line WSL, a source thereof is connected to the data line DTL, and a drain thereof is connected to a gate of the driving transistor Tr2 and one end of the capacitor Cs. The gate of the driving transistor Tr2 is connected to the drain of the writing transistor Tr1 and the one end of the capacitor Cs, a drain thereof is connected to the power line DSL, and a source thereof is connected to the other end of the capacitor Cs and an anode of the organic EL device 12. It is to be noted that a type of TFT is not particularly limited, and may be, for example, an inverse-staggered structure (a so-called bottom-gate type) or a staggered structure (a so-called top-gate type).

The one end of the capacitor Cs is connected to the gate of the driving transistor Tr2, and the other end thereof is connected to the source of the driving transistor Tr2. The organic EL device 12 is a light emitting device that emits light of a color corresponding to each of the pixels 11R, 11G, and 11B. The anode of the organic EL device 12 is connected to the source of the driving transistor Tr2 and the other end of the capacitor Cs, and a cathode thereof is grounded. One end of the capacitor Csub is connected to the anode of the organic EL device 12, and the other end thereof is grounded.

The drive circuit 20 drives the display panel 10 based on an image signal Sdisp and a synchronization signal Ssync that are supplied from outside. As shown in FIG. 1, this display circuit 20 includes an image signal processing circuit 21, a timing generation circuit 22, a scanning line drive circuit 23, a data line drive circuit 24, and a power line drive circuit 25.

The image signal processing circuit 21 performs predetermined correction on the digital image signal Sdisp supplied from the outside, and outputs a corrected image signal Sdisp2 to the data line drive circuit 24. Examples of this predetermined correction may include gamma correction and overdrive correction.

The timing generation circuit 22 is a circuit that supplies a control signal to each of the control signal scanning line drive circuit 23, the data line drive circuit 24, and the power line drive circuit 25, based on the synchronization signal Ssync inputted from the outside, and that performs control to allow these circuits to operate in synchronization with one another.

The scanning line drive circuit 23 sequentially applies scanning line signals WS to the plurality of scanning lines WSL in accordance with the control signal supplied from the timing generation circuit 22, and thereby, sequentially selects the plurality of pixels 11. Specifically, the scanning line drive circuit 23 selectively outputs a voltage Von and a voltage Voff, and thereby, generates the above-described scanning line signals WS. The voltage Von is to be applied when the writing transistor Tr1 is set to an ON state. The voltage Voff is to be applied when the writing transistor Tr1 is set to an OFF state.

The data line drive circuit 24 generates a data line signal Sig that includes an analog image signal (a luminance signal) in accordance with the control signal supplied from the timing generation circuit 22, and to apply the generated data line signal Sig to each data line DTL.

Figure 3:
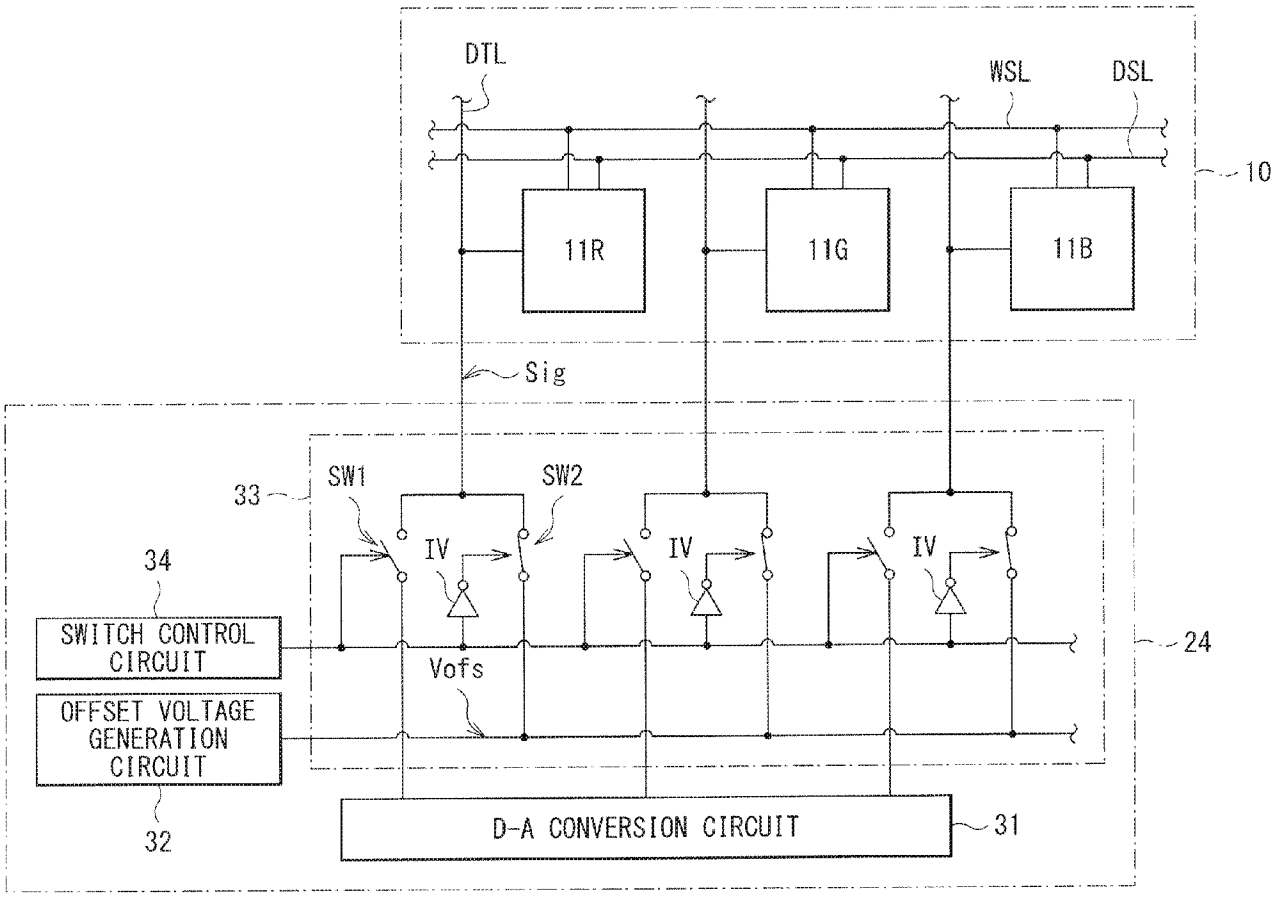
FIG. 3 is a block diagram illustrating a configuration example of a main part of a data line drive circuit shown in FIG. 1.

FIG. 3 illustrates a configuration example of a main part of the data line drive circuit 24. The data line drive circuit 24 includes a D-A (Digital-Analog) conversion circuit 31, an offset voltage generation section 32, a switch section 33, and a switch control circuit 34.

The D-A conversion circuit 31 performs D-A conversion on a digital signal based on the image signal Sdisp2, and thereby, generates a pixel voltage Vpix to be supplied to the pixel 11. The offset voltage generation circuit 32 generates an offset voltage Vofs (which will be described later).

The switch section 33 time-divisionally selects the pixel voltage Vpix supplied from the D-A conversion circuit 31 and the offset voltage Vofs supplied from the offset voltage generation circuit 32, based on an instruction from the switch control circuit 34, and supplies the selected voltage to the data line DTL.

The switch section 33 includes an inverter IV and switches SW1 and SW2. The inverter IV inverts an SW control signal supplied from the switch control circuit 34, and outputs the inverted signal. The switch SW1 is turned on or off based on the SW control signal supplied from the switch control circuit 34. To one end of the switch SW1, the pixel voltage Vpix is supplied from the D-A conversion circuit 31. The other end of the switch SW1 is connected to the other end of the switch SW2, and is connected to the data line DTL. The switch SW2 is turned on or off based on the output signal from the inverter IV. To one end of the switch SW2, the offset voltage Vofs is supplied from the offset voltage generation circuit 32. The other end of the switch SW2 is connected to the other end of the switch SW1, and is connected to the data line DTL.

The switch control circuit 34 generates the SW control signals for controlling ON and OFF of the switches SW1 and SW2 in the switch section 33, and supplies the generated SW control signals to the switch section 33.

Due to this configuration, the data line drive circuit 24 time-divisionally applies the offset voltage Vofs and the pixel voltage Vpix to each data line DTL, and thereby, drives each pixel 11 in the display panel 10. Specifically, as will be described later, the data line drive circuit 24 applies the offset voltage Vofs to the data line DTL in initialization periods P1 and P2 (which will be described later) and Vth correction periods P3 and P4 (which will be described later), and applies the pixel voltage Vpix to the data line DTL in a signal writing period P5 (which will be described later).

Here, as will be described later, the initialization periods P1 and P2 are each a period in which the pixel 11 is initialized by increasing a gate-source voltage Vgs of the driving transistor Tr2 in the pixel 11 to be larger than a threshold voltage Vth of the driving transistor Tr2 based on the offset voltage Vofs. Further, as will be described later, the Vth correction periods P3 and P4 are each a period in which the threshold voltage Vth of the driving transistor Tr2 is corrected based on the offset voltage Vofs. Further, the signal writing period P5 is a period in which a predetermined voltage in accordance with the pixel voltage Vpix is set between the gate and the source of the driving transistor Tr2. As will be described later, the initialization periods P1 and P2 (which will be described later) are shorter than the Vth correction periods P3 and P4 (which will be described later) in the display unit 1.

The power line drive circuit 25 sequentially applies power line signals DS to the plurality of power lines DSL in accordance with the control signal supplied from the timing generation circuit 22, and thereby controls a light emission operation and a light extinction operation of each organic EL device 12. Specifically, as will be described later, the power line drive circuit 25 applies a voltage Vini that is lower than the offset voltage Vofs to each power line DSL in the initialization periods P1 and P2 (which will be described later), and applies a voltage Vccp that is higher than the offset voltage Vofs thereto in the Vth correction periods P3 and P4 (which will be described later) and the signal writing period (P5) (which will be described later).

Here, the drive circuit 20 corresponds to a specific example of "drive section" in the present disclosure. The initialization periods P1 and P2 correspond to specific examples of "first preparation period" in the present disclosure. The Vth correction periods P3 and P4 correspond to specific examples of "second preparation period" in the present disclosure. The signal writing period P5 corresponds to a specific example of "writing period" in the present disclosure. The offset voltage Vofs corresponds to a specific example of "first voltage" in the present disclosure. The voltage Vini corresponds to a specific example of "second voltage" in the present disclosure. The voltage Vccp corresponds to a specific example of "third voltage" in the present disclosure.

[Operations and Functions]

Subsequently, description will be given on operations and functions of the display unit 1 of the present embodiment.

[Outline of General Operation]

First, outline of a general operation of the display unit 1 will be described referring to FIG. 1. The drive circuit 20 performs display drive on the display panel 10 based on the image signal Sdisp and the synchronization signal Ssync. Specifically, first, the image signal processing circuit 21 performs correction such as gamma correction and overdrive correction based on the image signal Sdisp, and thereby, generates the image signal Sdisp2. The timing control circuit 22 controls the scanning line drive circuit 23, the data line drive circuit 24, and the power line drive circuit 25 based on the synchronization signal Ssync. The scanning line drive circuit 23 generates the scanning line signal WS, and sequentially applies the generated scanning line signals WS to the plurality of scanning lines WSL. The data line drive circuit 24 generates the data line signal Sig that includes the pixel voltage Vpix and the offset voltage Vofs, and applies the generated data line signal Sig to each of the plurality of data lines DTL. The power line drive circuit 25 generates the power line signal DS, and sequentially applies the generated power line signals DS to the plurality of power lines DSL. The display panel 10 performs display based on the scanning line signal WSL, the data line signal Sig, and the power line signal DS that have been supplied from the drive circuit 20.

[Detailed Operation]

Next, a detailed operation of the display unit 1 will be described.

Figure 4:
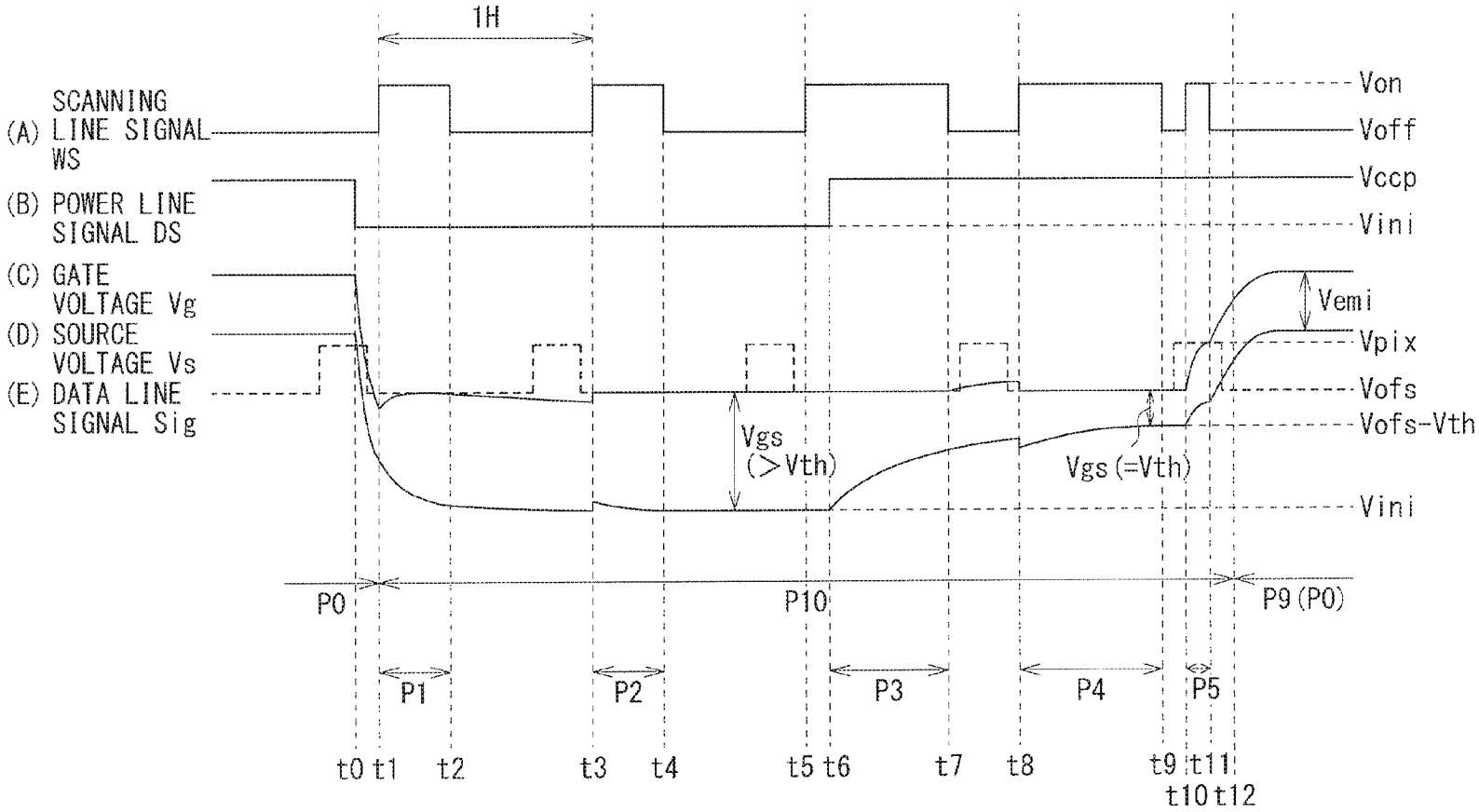
FIG. 4 is a timing waveform diagram illustrating an operation example of the display unit shown in FIG. 1.

FIG. 4 illustrates a timing diagram of a display operation in the display unit 1. This diagram illustrates an operation example of the display drive on one focused pixel. In FIG. 4, (A) shows a waveform of the scanning line signal WS, (B) shows a waveform of the power line signal DS, (C) shows a waveform of a gate voltage Vg of the driving transistor Tr2, (D) shows a waveform of a source voltage Vs of the driving transistor Tr2, and (E) shows a waveform of the data line signal Sig. The respective waveforms are shown with the use of the same voltage axis in (C) to (E) in FIG. 4.

Each pixel 11 in the display unit 1 performs the display operation by alternately repeating light emission (a light emission period P0) and light extinction (a light extinction period P10). Specifically, in the light extinction period P10, each pixel 11 first performs initialization in each of a plurality of (two, in this example) horizontal period (1H)s (the initialization periods P1 and P2), and performs Vth correction of the driving transistor Tr2 in each of a plurality of (two, in this example) horizontal periods subsequent thereto (the Vth correction periods P3 and P4). Further, the pixel voltage Vpix is written in the pixel 11 in the signal writing period P5 subsequent to the Vth correction period P4. Thereafter, the pixel 11 emits light in a light emission period P9. In other words, in this example, the display unit 1 performs the initialization, the Vth correction, and writing of a signal on each pixel 11 in a period corresponding to four horizontal periods. Hereinafter, details thereof will be described.

First, at a timing t0, the power line drive circuit 25 decreases a voltage of the power line signal DS from the voltage Vccp to the voltage Vini ((B) of FIG. 4) in a period in which a voltage of the scanning line signal WS is the voltage Voff ((A) of FIG. 4). Accordingly, the source voltage Vs of the driving transistor Tr2 begins to decrease toward the voltage Vini ((D) of FIG. 4), and in accordance therewith, the gate voltage Vg of the driving transistor Tr2 begins to decrease ((C) of FIG. 4). Further, the pixel 11 extinguishes light, and a light extinction period P10 begins.

Next, in a period (the initialization period P1) from a timing t1 to a timing t2, the drive circuit 20 performs first initialization on the pixel 11. Specifically, at the timing t1, the scanning line drive circuit 23 first increases the voltage of the scanning line signal WS from the voltage Voff to the voltage Von ((A) of FIG. 4) in a period in which the data line drive circuit 24 is outputting the offset voltage Vofs as the data line signal Sig ((E) of FIG. 4). As a result, the writing transistor Tr1 becomes an ON state, and the gate voltage Vg of the driving transistor Tr2 becomes the offset voltage Vofs ((C) of FIG. 4). On the other hand, the source voltage Vs of the driving transistor Tr2 continues to decrease toward the voltage Vini ((D) of FIG. 4).

Next, at the timing t2, the scanning line drive circuit 23 decreases the voltage of the scanning line signal WS from the voltage Von to the voltage Voff ((A) of FIG. 4). As a result, the writing transistor Tr1 becomes an OFF state. At that time, the gate of the driving transistor Tr2 becomes a floating state, and a voltage (the voltage Vgs) between the both terminals of the capacitor Cs is maintained. Therefore, in a period from the timing t2 to a timing t3, the gate voltage Vg of the driving transistor Tr2 decreases in accordance with variation in the source voltage Vs of the driving transistor Tr2 ((C) and (D) of FIG. 4).

Next, in a period (the initialization period P2) from the timing t3 to a timing t4, the drive circuit 20 performs second initialization on the pixel 11. An operation thereof is similar to that in the above-described case of the initialization period P1. Specifically, at the timing t3, the scanning line drive circuit 23 first increases the voltage of the scanning line signal WS from the voltage Voff to the voltage Von ((A) of FIG. 4) in a period in which the data line drive circuit 24 is outputting the offset voltage Vofs as the data line signal Sig ((E) of FIG. 4). As a result, the writing transistor Tr1 becomes an ON state, and the gate voltage Vg of the driving transistor Tr2 becomes the offset voltage Vofs ((C) of FIG. 4). On the other hand, the source voltage Vs of the driving transistor Tr2 converges to the voltage Vini ((D) of FIG. 4). The gate-source voltage Vgs of the driving transistor Tr2 in this final state is higher than the threshold voltage Vth of this driving transistor Tr2 (Vgs>Vth) as shown in FIG. 4. Thus, initialization of the pixel 11 is completed.

Next, at the timing t4, the scanning line drive circuit 23 decreases the voltage of the scanning line signal WS from the voltage Von to the voltage Voff ((A) of FIG. 4). As a result, the writing transistor Tr1 becomes an OFF state, and the voltage (the voltage Vgs) between the both terminals of the capacitor Cs is maintained. At that time, the source voltage Vs of the driving transistor Tr2 has already converged to the voltage Vini at the timing t4, and therefore, does not vary ((D) of FIG. 4). Therefore, in a period from the timing t4 to a timing t5, the gate voltage Vg of the driving transistor Tr2 is almost maintained at the offset voltage Vofs ((C) of FIG. 4).

Next, in a period (the Vth correction period P3) from a timing t6 to a timing t7, the drive circuit 20 performs first Vth correction on the pixel 11. Specifically, prior to this Vth correction, at the timing t5, the scanning line drive circuit 23 first increases the voltage of the scanning line signal WS from the voltage Voff to the voltage Von ((A) of FIG. 4) in a period in which the data line drive circuit 24 is outputting the offset voltage Vofs as the data line signal Sig ((E) of FIG. 4). Next, at the timing t6, the power line drive circuit 25 increases the voltage of the power line signal DS from the voltage Vini to the voltage Vccp ((B) of FIG. 4). As a result, in the period from the timing t6 to the timing t7, a current Id flows between the drain and the source of the driving transistor Tr2 and the device capacitance Csub is charged, and thereby, the source voltage Vs of the driving transistor Tr2 increases ((D) of FIG. 4). On the other hand, the gate voltage Vg of the driving transistor Tr2 is maintained at the offset voltage Vofs ((C) of FIG. 4), because the writing transistor Tr1 is in an ON state. In such a manner, the gate-source voltage Vgs of the driving transistor Tr2 decreases as time elapses in the period from the timing t6 to the timing t7.

This operation is a so-called negative feedback operation. Specifically, as described above, when the current Id flows between the drain and the source of the driving transistor Tr2 and the gate-source voltage Vgs decreases, the current Id between the drain and the source decreases. In other words, the current Id between the drain and the source of the driving transistor Tr2 converges toward 0 (zero) due to this negative feedback operation. In other words, the gate-source voltage Vgs of the driving transistor Tr2 converses so as to be equal to the threshold voltage Vth of the driving transistor Tr2 (Vgs=Vth) due to this negative feedback operation.

Next, at the timing t7, the scanning line drive circuit 23 decreases the voltage of the scanning line signal WS from the voltage Von to the voltage Voff ((A) of FIG. 4). As a result, the writing transistor Tr1 becomes an OFF state, and the voltage (the voltage Vgs) between the both terminals of the capacitor Cs is maintained. Therefore, in a period from the timing t7 to a timing t8, the gate voltage Vg of the driving transistor Tr2 increases in accordance with variation in the source voltage Vs of the driving transistor Tr2 ((C) and (D) of FIG. 4).

Next, in a period (the Vth correction period P4) from the timing t8 to a timing t9, the drive circuit 20 performs second Vth correction on the pixel 11. An operation thereof is similar to that in the above-described case of the Vth correction period P3. Specifically, at the timing t8, the scanning line drive circuit 23 increases the voltage of the scanning line signal WS from the voltage Voff to the voltage Von ((A) of FIG. 4) in a period in which the data line drive circuit 24 is outputting the offset voltage Vofs as the data line signal Sig ((E) of FIG. 4). As a result, in the period from the timing t8 to the timing t9, the current Id flows between the drain and the source of the driving transistor Tr2 and the device capacitance Csub is charged, and thereby, the source voltage Vs of the driving transistor Tr2 increases ((D) of FIG. 4). Accordingly, the gate-source voltage Vgs of the driving transistor Tr2 becomes equal to the threshold voltage Vth of the driving transistor Tr2 due to the above-described negative feedback operation. In other words, the source voltage Vs of the driving transistor Tr2 converses to a voltage (Vofs-Vth). Thus, the Vth correction of the driving transistor Tr2 is completed.

Next, at the timing t9, the scanning line drive circuit 23 decreases the voltage of the scanning line signal WS from the voltage Von to the voltage Voff ((A) of FIG. 4). As a result, the writing transistor Tr1 becomes an OFF state.

Next, in a period (the signal writing period P5) from a timing t10 to a timing t11, the drive circuit 20 performs writing of the pixel voltage Vpix on the pixel 11. Specifically, prior to this writing of the pixel voltage Vpix, the data line drive circuit 24 first increases the voltage of the data line signal Sig from the offset voltage Vofs to the pixel voltage Vpix ((E) of FIG. 4). Further, at the timing t10, the scanning line drive circuit 23 increases the voltage of the scanning line signal WS from the voltage Voff to the voltage Von ((A) of FIG. 4). As a result, the writing transistor Tr1 becomes an ON state. Therefore, the gate voltage Vg of the driving transistor Tr2 increases to the pixel voltage Vpix ((C) of FIG. 4). At this time, the gate-source voltage Vgs of the driving transistor Tr2 becomes higher than the threshold voltage Vth (Vgs>Vth) and the current Id flows between the drain and the source. Therefore, the device capacitance Csub is charged, and the source voltage Vs of the driving transistor Tr2 increases ((D) of FIG. 4). By the above-described operations, the gate-source voltage Vgs of the driving transistor Tr2 is set to a voltage Vemi corresponding to the pixel voltage Vpix. Thus, the writing of the pixel voltage Vpix is completed.

Next, at the timing t11, the scanning line drive circuit 23 decreases the voltage of the scanning line signal WS from the voltage Von to the voltage Voff ((A) of FIG. 4). As a result, the writing transistor Tr1 becomes an OFF state, and the gate of the driving transistor Tr2 becomes floating. Therefore, thereafter, the voltage between the terminals of the capacitor Cs, that is, the gate-source voltage Vgs of the driving transistor Tr2 is maintained at the voltage Vemi. At this time, the current Id flows between the drain and the source. Therefore, the device capacitance Csub is charged, and the source voltage Vs of the driving transistor Tr2 increases ((D) of FIG. 4). In accordance therewith, the gate voltage Vg of the driving transistor Tr2 also increases ((E) of FIG. 4). Further, when the voltage of the anode of the organic EL device 12 that is connected to the source of the driving transistor Tr2 becomes larger than a threshold voltage Vel of this organic EL device 12, a current flows between the anode and the cathode of the organic EL device 12, the organic EL device 12 emits light, and the light emission period P9 begins.

Thereafter, after a predetermined period elapses, the display unit 1 moves from the light emission period P9 (P0) to the light extinction period P10. Further, the drive circuit 20 performs drive so as to repeat this series of operations.

Figure 5:
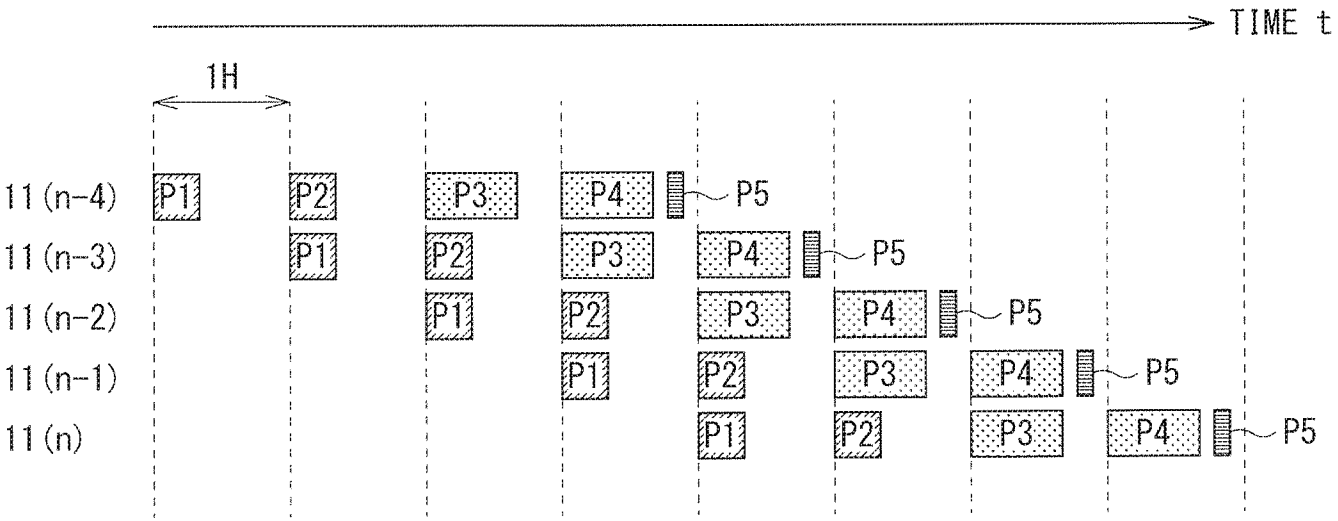
FIG. 5 is a schematic diagram illustrating an operation example in each row in the display unit shown in FIG. 1.

FIG. 5 illustrates operation states of the pixels 11 in respective rows in the display panel 10, and illustrates operation states of the respective pixels 11 in five rows in total from an (n−4)th row to an n-th row. Here, for example, a pixel 11(*n*) represents the pixel 11 in the n-th row, and a pixel 11(*n*−1) represents the pixel 11 in the (n−1)th row.

As shown in FIG. 5, each pixel 11 in the display unit 1 performs the initialization, the Vth correction, and the signal writing in a period corresponding to four horizontal period (1H)s. Specifically, the pixel 11 performs the initialization in each of the initialization period P1 in a first horizontal period, and the initialization period P2 in a second horizontal period. The pixel 11 performs the Vth correction in each of the Vth correction period P3 in a third horizontal period and the Vth correction period P4 in a last horizontal period. Further, in the signal writing period P5 subsequent to the Vth correction period P4 in that last horizontal period, the pixel signal Vpix is written in the pixel 11. Subsequently, the pixel 11 emits light based on that pixel signal Vpix.

The display unit 1 performs this series of operations for the respective pixels 11 on a row basis so as to allow the operations to be shifted by one horizontal period. Specifically, for example, in the display unit 1, when the pixel 11(*n*) in the n-th row performs the first initialization operation in the initialization period P1, the pixel 11(*n*−1) in the (n−1)th row may perform the second initialization operation in the initialization period P2. Similarly, for example, when the pixel 11(*n*) in the n-th row performs the second initialization operation in the initialization period P2, the pixel 11(*n*−1) in the (n−1)th row performs the first Vth correction operation in the Vth correction period P3.

As shown in FIG. 5, in the display unit 1, the initialization periods P1 and P2 of one pixel 11 (for example, the pixel 11(*n*)) are arranged in horizontal periods same as those of the Vth correction periods P3 and P4 of another pixel 11 (for example, the pixel 11(*n*−2)). At that time, in the same horizontal period, the initialization periods P1 and P2 of one pixel 11 (for example, the pixel 11(*n*)) are shorter than the Vth correction periods P3 and P4 of another pixel 11 (for example, the pixel 11(*n*−2)), and therefore, end early.

[Concerning Display Defect]

Next, description will be given on a defect of the pixel in the display unit.

Figure 6:
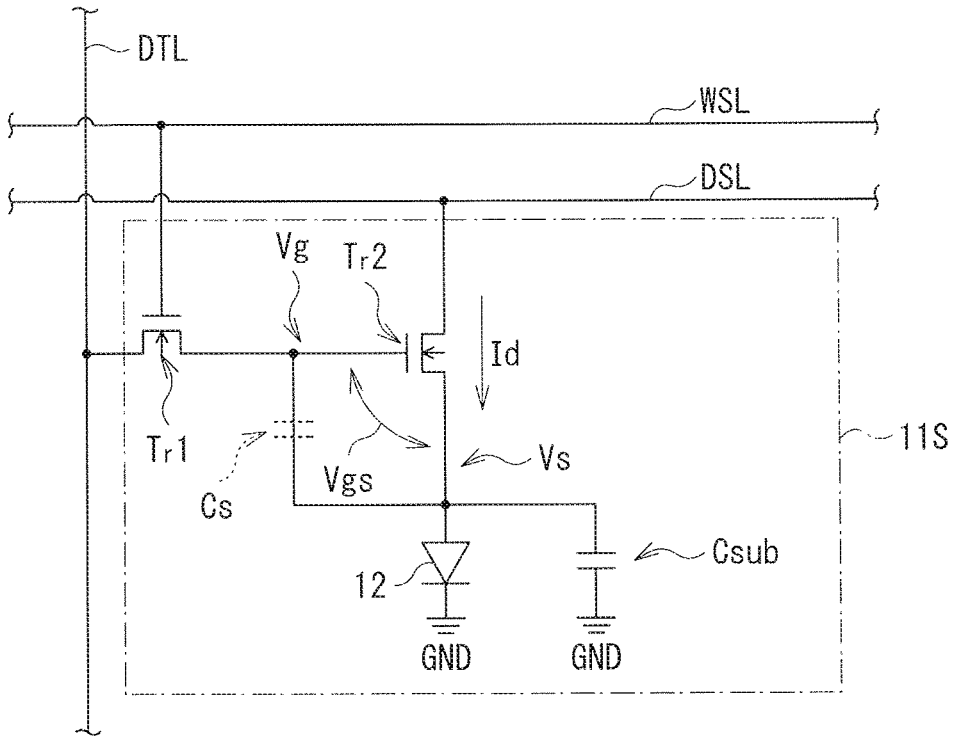
FIG. 6 is a circuit diagram illustrating a configuration example of a defective pixel.

FIG. 6 illustrates an example of a pixel in which a point defect has occurred. In the display unit that uses the organic EL device, the point defect may occur, for example, by short-circuit between the both terminals of the capacitor Cs as shown in FIG. 6. In such a pixel 11 (hereinafter, also referred to as "defective pixel 11S"), the gate-source voltage Vgs of the driving transistor Tr2 becomes 0 V, and the driving transistor Tr2 is kept in an OFF state. Therefore, display in accordance with the pixel signal Vpix is not allowed to be performed, and the dot defect occurs.

Also, the defective pixel 11S is not allowed to normally perform operations such as the initialization operation and the Vth correction operation. Specifically, as shown in FIG. 4, for example, in the initialization periods P1 and P2, the offset voltage Vofs is supplied from the data line drive circuit 24 to the gate of the driving transistor Tr2 via the writing transistor Tr1 in an ON state, and the voltage Vini is supplied from the power line drive circuit 25 to the source of the driving transistor Tr2 via the driving transistor Tr2 in an ON state. Therefore, in a case, as of the defective pixel 11S, where the both terminals of the capacitor Cs is short-circuited, the offset voltage Vofs and the voltage Vini become closer to each other, the offset voltage Vofs decreases, the voltage Vini increases, and for example, the voltage Vofs and the voltage Vini may have almost-equal voltage values in this initialization periods P1 and P2. Therefore, the defective pixel 11S is not allowed to normally perform the initialization operation.

Further, in the initialization periods P1 and P2, the offset voltage Vofs that has decreased as described above is supplied also to other pixels 11 via the data lines DTL as will be described below.

Figure 7:
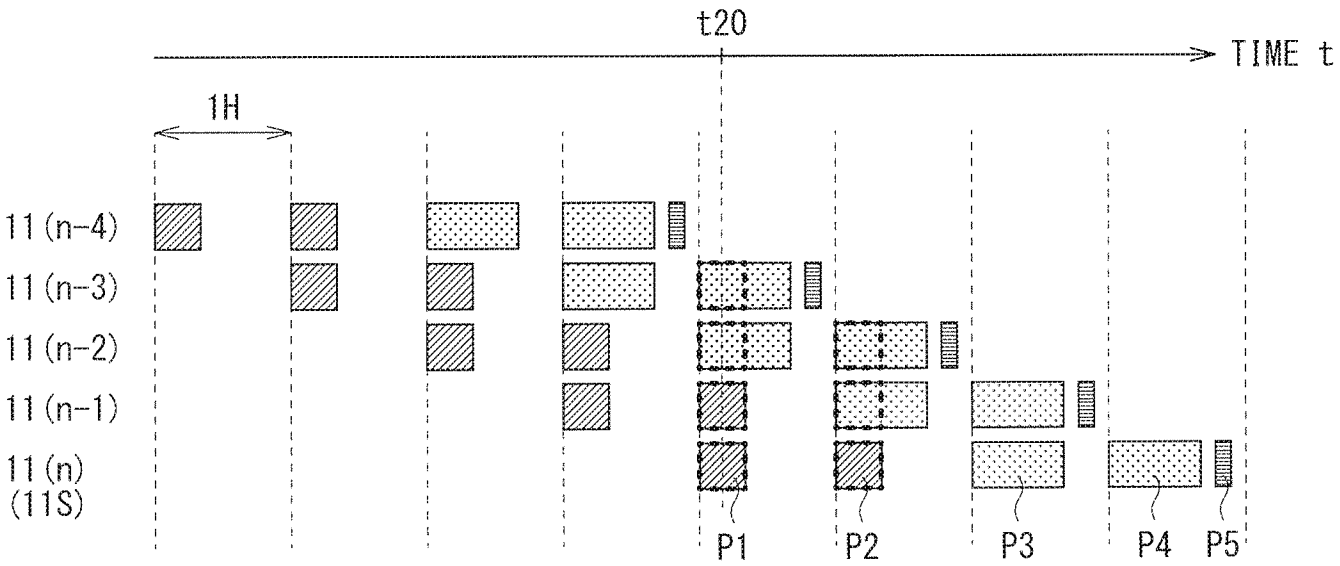
FIG. 7 is a schematic diagram illustrating an operation example of the display unit when the display unit includes the defective pixel.

FIG. 7 illustrates operation states of the respective pixels 11 from the (n−4)th row to the n-th row in a case where the pixel 11(*n*) in the n-th row is the defective pixel 11S. For example, in the display unit 1, at a timing t20, the pixel 11(*n*) performs the first initialization operation in the initialization period P1, the pixel 11(*n*−2) performs the first Vth correction operation in the Vth correction period P3, and the pixel 11(*n*−3) performs the second Vth correction in the Vth correction period P4.

Figure 8:
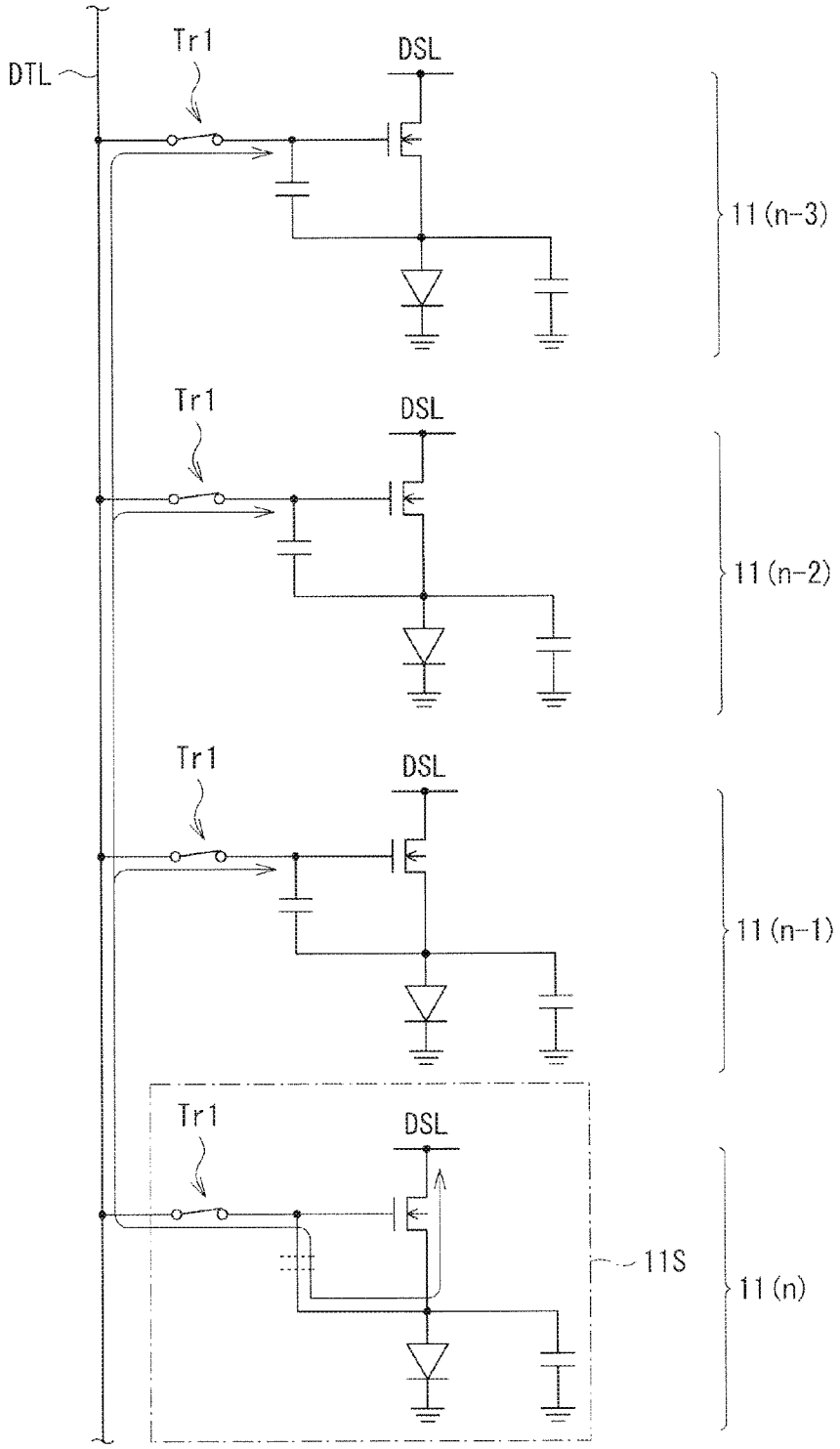
FIG. 8 is a circuit diagram illustrating a state of each pixel in an initialization period and a Vth correction period.

FIG. 8 illustrates the states of the pixels 11 in the respective row at the timing t20 shown in FIG. 7. It is to be noted that the writing transistor Tr1 is illustrated using a switch that shows an ON-OFF state at the timing t20 in this diagram for the sake of convenience in description.

As shown in FIGS. 7 and 8, at the timing 20, the pixels 11(*n*) and 11(*n*−1) perform the initialization operation, and the pixels 11(*n*−3) and 11(*n*−2) perform the Vth correction operation. Therefore, all of the writing transistors Tr1 in these pixels 11(*n*−3) to 11(*n*) are in an ON state. Accordingly, the offset voltage Vofs that has decreased due to the initialization operation on the defective pixel 11S (the pixel 11(*n*)) is also supplied, via the data lines DTL, to the pixels 11(*n*−3) and 11(*n*−2) that perform the Vth correction operation.

Next, description will be given on an operation of the pixel 11(*n*−3).

Figure 9:
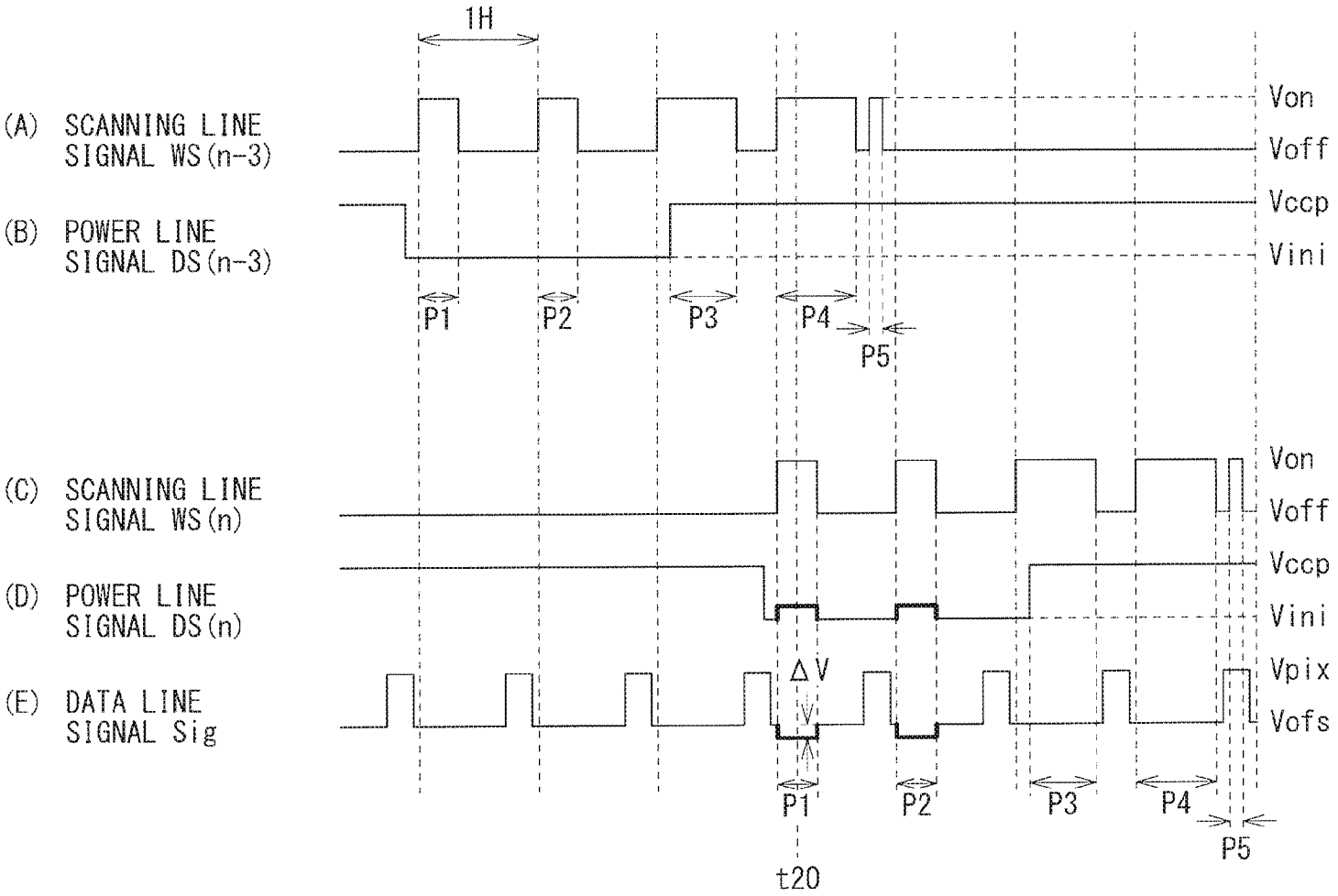
FIG. 9 is a timing waveform diagram illustrating an operation example of the display unit when the display unit includes the defective pixel.

FIG. 9 illustrates a timing diagram of operations of the pixel 11(*n*−3) and the pixel 11(*n*) (the defective pixel 11S). (A) shows a waveform of a scanning line signal WS(n−3) to be supplied to the pixel 11(*n*−3), (B) shows a waveform of a power line signal DS(n−3) to be supplied to the pixel 11(*n*−3), (C) shows a waveform of a scanning line signal WS(n) to be supplied to the pixel 11(*n*), (D) shows a waveform of a power line signal DS(n) to be supplied to the pixel 11(*n*), and (E) shows a waveform of the data line signal Sig to be supplied to the pixel 11(*n*−3) and the pixel 11(*n*).

As shown in FIG. 9, in the initialization periods P1 and P2 of the pixel 11(*n*) (the defective pixel 11S), because the both terminals of the capacitor Cs are short-circuited, the offset voltage Vofs of the data line signal Sig decreases by a voltage ΔV toward the voltage Vini ((E) of FIG. 9), and the voltage Vini of the power line signal DS(n) increases toward the offset voltage Vofs ((D) of FIG. 9). The pixel 11(*n*−3) performs the Vth correction operation based on such a voltage of the data line signal Sig.

Figure 10:
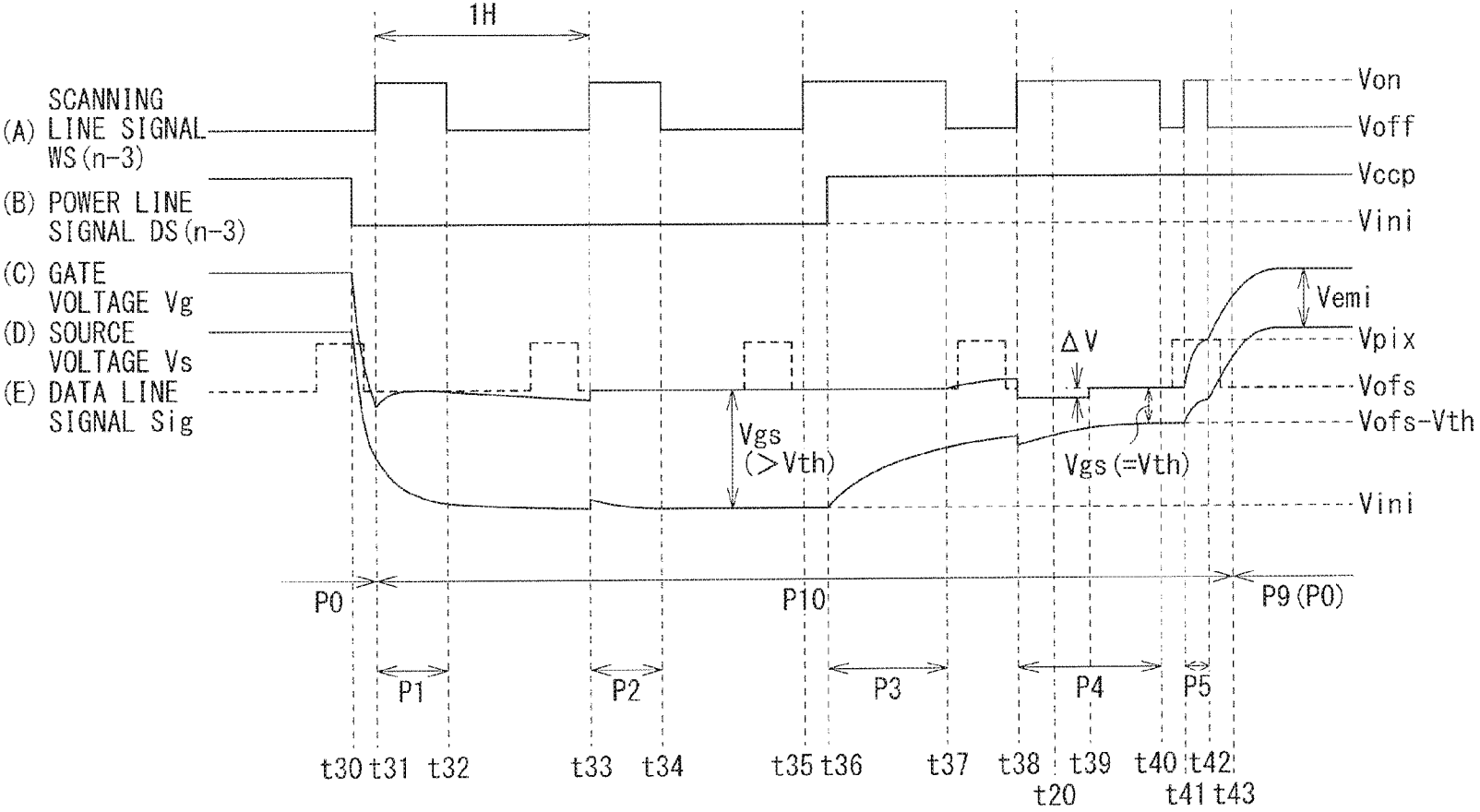
FIG. 10 is another timing waveform diagram illustrating an operation example of the display unit when the display unit includes the defective pixel.

FIG. 10 illustrates a timing diagram of an operation of the pixel 11(*n*−3). (A) shows a waveform of the scanning line signal WS(n−3), (B) shows a waveform of the power line signal DS(n−3), (C) shows a waveform of the gate voltage Vg of the driving transistor Tr2, (D) shows a waveform of the source voltage Vs of the driving transistor Tr2, and (E) shows a waveform of the data line signal Sig.

The drive circuit 20 drives the pixel 11(*n*−3) in a manner similar to that in the timing diagram shown in FIG. 4. Specifically, the drive circuit 20 drives the pixel 11(*n*−3) so as to perform the first initialization on the pixel 11(*n*−3) in a period (the initialization period P1) from a timing t31 to a timing t32, to perform the second initialization operation on the pixel 11(*n*−3) in a period (the initialization period P2) from a timing t33 to a timing t34, and to perform the first Vth correction operation on the pixel 11(*n*−3) in a period (the Vth correction period P3) from a timing t36 to a timing t37.

Next, in a period (the Vth correction period P4) from a timing t38 to a timing t40, the drive circuit 20 performs the second Vth correction. Specifically, the scanning line drive circuit 23 first increases a voltage of the scanning line signal WS(n−3) from the voltage Voff to the voltage Von ((A) of FIG. 10). At this time, as described using FIG. 9, the offset voltage Vofs of the data line signal Sig decreases by the voltage ΔV in a period from the timing t38 to a timing t39 ((E) of FIG. 10). In other words, in the period from the timing t38 to the timing t39, the offset voltage Vofs and the voltage Vini become close to each other in the defective pixel 11S (the pixel 11(*n*)). Therefore, the offset voltage Vofs decreases. As a result, in the pixel 11(*n*−3), the current Id flows between the drain and the source of the driving transistor Tr2 and the device capacitance Csub is charged, and thereby, the source voltage Vs of the driving transistor Tr2 increases ((D) of FIG. 10). Subsequently, at the timing t39, when the offset voltage Vofs increases by the voltage ΔV and returns to the original voltage, the source voltage Vs of the driving transistor Tr2 increases until the gate-source voltage Vgs of the driving transistor Tr2 becomes equal to the threshold voltage Vth of the driving transistor Tr2 due to the negative feedback operation. As a result, the source voltage Vs of the driving transistor Tr2 converges to the voltage (Vofs-Vth) ((D) of FIG. 10), and the Vth correction is completed.

Subsequently, in a period (the signal writing period P5) from a timing t41 to a timing t42, the drive circuit 20 performs the writing of the pixel voltage Vpix in the pixel 11(*n*−3) in a manner similar to that in the timing diagram shown in FIG. 4. Therefore, the gate-source voltage Vgs of the driving transistor Tr2 is set to the voltage Vemi corresponding to the pixel voltage Vpix. Further, at the timing t42, after the drive circuit 20 decreases the voltage of the scanning line signal WS(n−3) from the voltage Von to the voltage Voff, the organic EL device 12 emits light with luminance in correspondence with this voltage Vemi.

In such a manner, in the display unit 1, even when the point defect occurs in part (for example, the pixel 11(*n*)) of the pixels, it is possible to suppress the influence on the display operation in another pixel (for example, the pixel 11(*n*−3)), unlike in a display unit according to a comparative example which will be described later.

Comparative Example

Next, description will be given on a display unit 1R according to the comparative example. End timings of the initialization periods P1 and P2 in the horizontal period (1H) is different from those in the case of the present embodiment. Specifically, in the present embodiment, the initialization periods P1 and P2 end earlier than the Vth correction periods P3 and P4 in another row in the horizontal period (1H). However, in the present comparative example, the initialization periods P1 and P2 end at the same time with the Vth correction periods P3 and P4 in another row in the horizontal period (1H).

Figure 11:
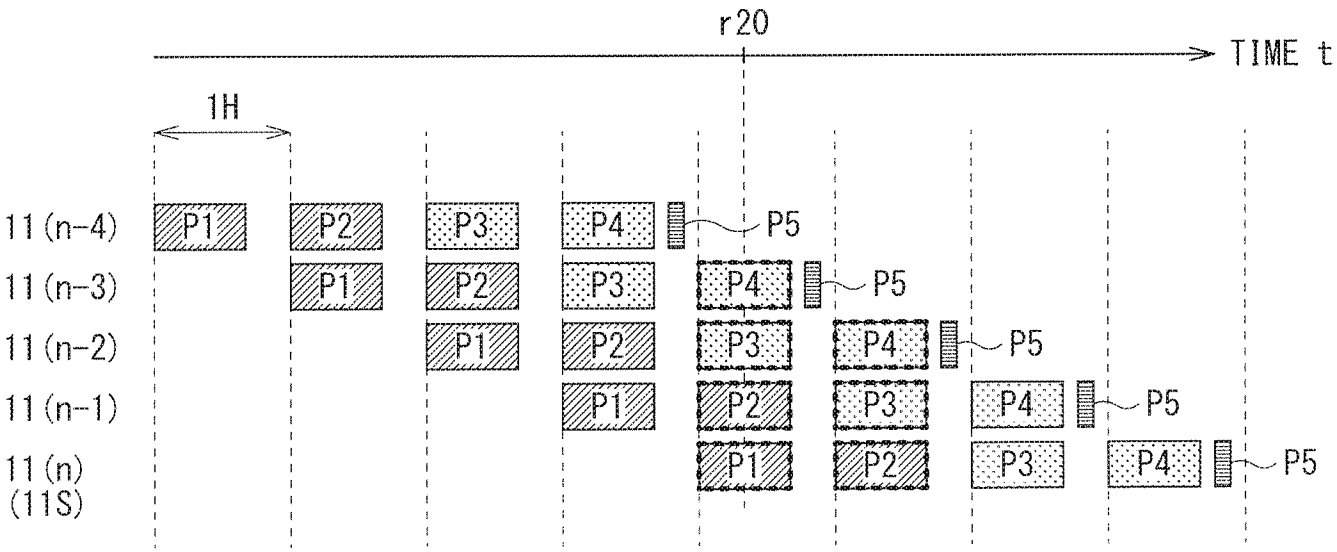
FIG. 11 is a schematic diagram illustrating an operation example of a display unit according to a comparative example.

FIG. 11 illustrates operation states of the respective pixels 11 from the (n−4)th row to the n-th row in a case where the pixel 11(*n*) is the defective pixel 11S in the display unit 1R according to the present comparative example. Similarly to the case (FIGS. 5 and 7) of the display unit 1 in the present embodiment, the display unit 1R performs the initialization, the Vth correction, and the signal writing on the pixels 11, and performs this series of operations on a row basis so as to allow the operations to be shifted by one horizontal period, in a period corresponding to four horizontal period (1H)s. At that time, in the display unit 1R, the initialization periods P1 and P2 end at the same time with the Vth correction periods P3 and P4 in each horizontal period (1H).

As shown in FIG. 11, at a timing r20, similarly to the case (FIG. 7) of the display unit 1 in the present embodiment, the pixels 11(*n*−3) to 11(*n*) from the (n−3)th row to the n-th row perform the initialization operation or the Vth correction operation. Therefore, all of the writing transistors Tr1 in these pixels become an ON state. As a result, the offset voltage Vofs that has become lower than a desirable value in the defective pixel 11S (the pixel 11(*n*)) is supplied also to the pixels 11(*n*−3) to 11(*n*−1) via the data line DTL.

Figure 12:
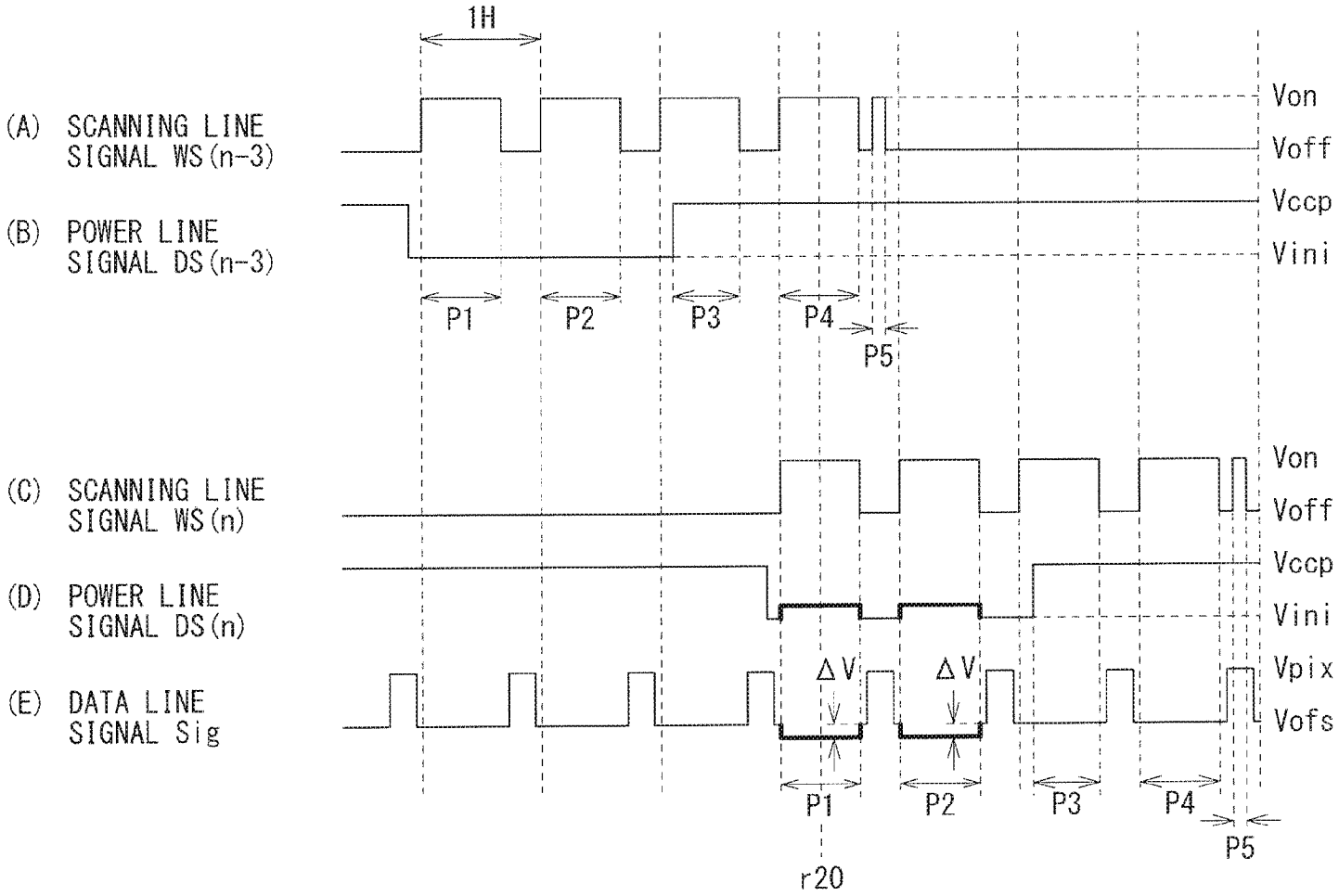
FIG. 12 is a timing waveform diagram illustrating an operation example of the display unit according to the comparative example.

FIG. 12 illustrates a timing diagram of operations of the pixel 11(*n*−3) and the pixel 11(*n*) (the defective pixel 11S) in the display unit 1R according to the present comparative example. (A) shows a waveform of the scanning line signal WS(n−3), (B) shows a waveform of the power line signal DS(n−3), (C) is a waveform of the scanning signal WS(n), (D) shows a waveform of the power line signal DS(n), and (E) shows a waveform of the data line signal Sig.

In the initialization periods P1 and P2 of the pixel 11(*n*) (the defective pixel 11S), because the both terminals of the capacitor Cs are short-circuited, the offset voltage Vofs of the data line signal Sig decreases by the voltage ΔV toward the voltage Vini ((E) of FIG. 12), and the voltage Vini of the power line signal DS(n) increases toward the offset voltage Vofs ((D) of FIG. 12), as in the case (FIG. 9) of the display unit 1 in the present embodiment.

Figure 13:
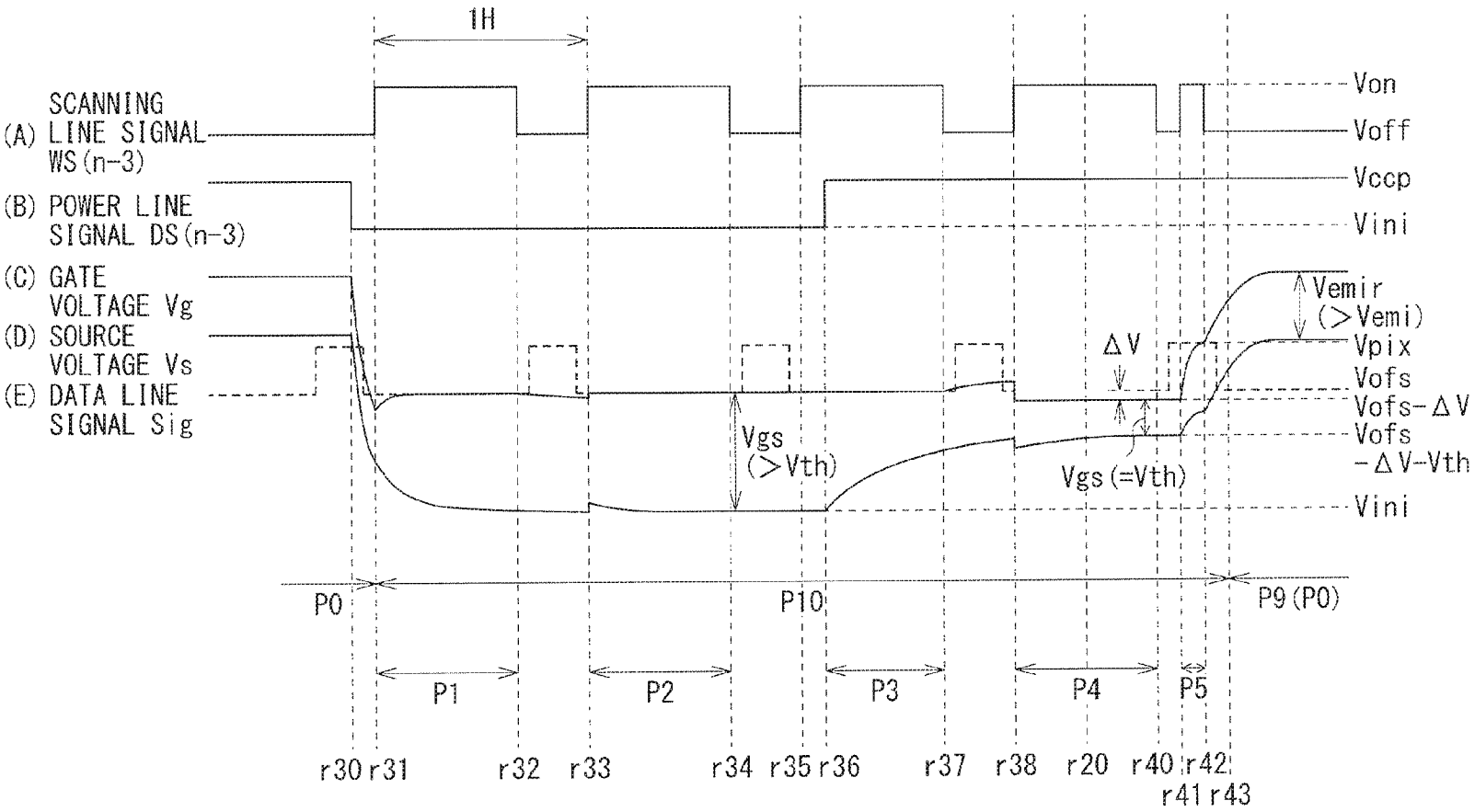
FIG. 13 is another timing waveform diagram illustrating an operation example of the display unit according to the comparative example.

FIG. 13 illustrates a timing diagram of an operation of the pixel 11(*n*−3) in the display unit 1R according to the present comparative example. (A) shows a waveform of the scanning line signal WS(n−3), (B) shows a waveform of the power line signal DS(n−3), (C) shows a waveform of the gate voltage Vg of the driving transistor Tr2, (D) shows a waveform of the source voltage Vs of the driving transistor Tr2, and (E) shows a waveform of the data line signal Sig.

A drive circuit 20R according to the display unit 1R performs drive so as to perform the first initialization on the pixel 11(*n*−3) in a period (the initialization period P1) from a timing r31 to a timing r32, to perform the second initialization operation on the pixel 11(*n*−3) in a period (the initialization period P2) from a timing r33 to a timing r34, and to perform the first Vth correction operation on the pixel 11(*n*−3) in a period (the Vth correction period P3) from a timing r36 to a timing r37. These operations are almost similar to those in the case of the present embodiment. It is to be noted that, in the display unit 1R, time periods of the initialization periods P1 and P2 are longer than those in the case of the present embodiment; however, the operations themselves in the initialization periods P1 and P2 are almost similar to those in the case of the present embodiment.

Next, in a period (the Vth correction period P4) from a timing r38 to a timing r40, the drive circuit 20R performs the second Vth correction. Specifically, the scanning line drive circuit 23 first increases a voltage of the scanning line signal WS(n−3) from the voltage Voff to the voltage Von ((A) of FIG. 13). At this time, as described using FIG. 12, the offset voltage Vofs of the data line signal Sig decreases by the voltage ΔV in the period from the timing r38 to the timing r40 ((E) of FIG. 13). As a result, in the pixel 11(*n*−3), the current Id flows between the drain and the source of the driving transistor Tr2 and the device capacitance Csub is charged. Also, the source voltage Vs of the driving transistor Tr2 increases until the gate-source voltage Vgs of the driving transistor Tr2 becomes equal to the threshold voltage Vth of the driving transistor Tr2 due to the negative feedback operation. Accordingly, the source voltage Vs of the driving transistor Tr2 converges to a voltage (Vofs-ΔV-Vth). In other words, in the display unit 1R according to the present comparative example, the source voltage Vs of the driving transistor Tr2 converges to a voltage that is lower than the converge voltage (Vofs-Vth) in the display unit 1 according to the present embodiment by the voltage ΔV ((D) of FIG. 13).

Next, at the timing r40, the scanning line drive circuit 23 decreases the voltage of the scanning line signal WS(n−3) from the voltage Von to the voltage Voff ((A) of FIG. 13). As a result, the writing transistor Tr1 becomes an OFF state. At this time, as described using FIG. 12, the offset voltage Vofs of the data line signal Sig increases by the voltage ΔV and returns to the original voltage ((E) of FIG. 13).

Subsequently, in a period (the signal writing period P5) from a timing r41 to a timing r42, the drive circuit 20R performs the writing of the pixel voltage Vpix in the pixel 11(*n*−3) in a manner similar to that in the timing diagram shown in FIG. 10. At that time, the source voltage Vs (=Vofs-ΔV-Vth) of the driving transistor Tr2 at the timing r41 is lower than the source voltage Vs (=Vofs-Vth) in the display unit 1 according to the present embodiment. Therefore, the gate-source voltage Vgs of the driving transistor Tr2 is set to a voltage Vemir that is higher than the voltage Vemi according to the present embodiment. Further, at the timing r42, after the drive circuit 20R decreases the voltage of the scanning line signal WS(n−3) from the voltage Von to the voltage Voff, the organic EL device 12 emits light with luminance in correspondence with this voltage Vemir. In other words, in the display unit 1R according to the present comparative example, the organic EL device 12 in the pixel 11(*n*−3) emits light with luminance that is higher than the desirable luminance.

As described above, in the display unit 1R according to the present comparative example, for example, when part of the pixels 11 includes the point defect, the display operation in other pixels may be influenced. Specifically, in the display unit 1R, as shown in FIG. 11, etc., the initialization periods P1 and P2 end at the same time as the Vth correction periods P3 and P4 in another row in the horizontal period (1H). As a result, as shown in FIG. 13, in the pixel 11(*n*−3), the source voltage Vs of the driving transistor Tr2 decreases at the timing r40 at which the Vth correction operation has ended in the second Vth correction period P4 immediately before the signal writing period P5. Therefore, the Vth correction is not allowed to be performed normally. Accordingly, in the signal writing period P4 immediately after that, the gate-source voltage Vgs of the driving transistor Tr2 is set to the high voltage Vemir, and therefore, light emission is performed with luminance that is higher than the desirable luminance.

In this example, description has been given that the pixel 11(*n*) (the defective pixel 11S) in the n-th row influences the display operation of the pixel 11(*n*−3) in the (n−3)th row. However, similarly, the pixel 11(*n*) (the defective pixel 11S) in the n-th row also influences the display operation of the pixel 11(*n*−2) in the (n−2)th row. Specifically, as shown in FIG. 11, in a manner similar to the manner in which the shift in the offset voltage Vofs in the initialization period P1 of the pixel 11(*n*) influences the operation in the Vth correction period P4 of the pixel 11(*n*−3), also the shift in the offset voltage Vofs in the initialization period P2 of the pixel 11(*n*) influences the operation in the Vth correction period P4 of the pixel 11(*n*−2).

Figure 14:
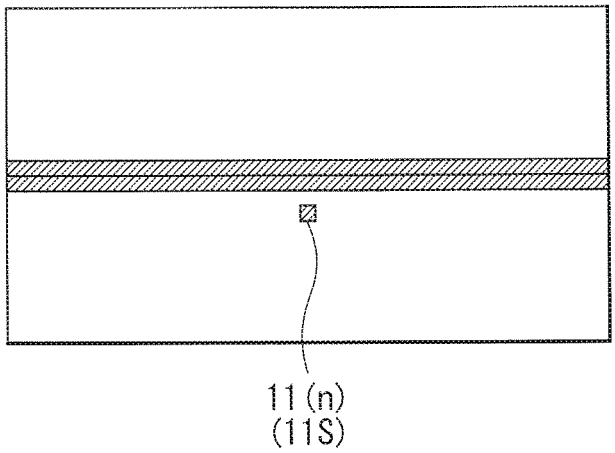
FIG. 14 is an explanation diagram illustrating a display defect in the display unit according to the comparative example.

Moreover, this offset voltage Vofs is supplied also to the pixels 11 in another row in the display panel 10. Specifically, as shown in FIG. 3, the offset voltage Vofs is generated by the offset voltage generation circuit 32 in the data line drive circuit 24, and is distributed and supplied to the pixels 11 in each column. Therefore, the offset voltage Vofs is also supplied to the pixels 11 in the (n−3)th row and the (n−2)th row in another column in the display panel 10. As a result, as shown in FIG. 14, line defects for two rows occur due to the point defect in the pixel 11(*n*) (the defective pixel 11S).

Figure 15:
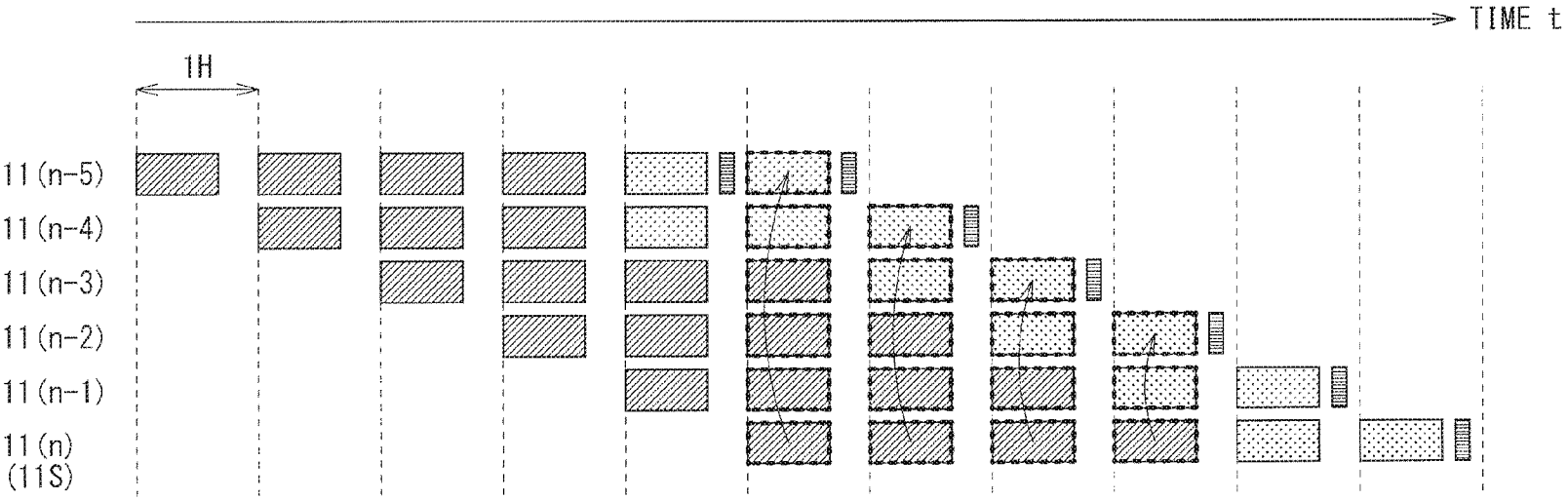
FIG. 15 is a schematic diagram illustrating another operation example of the display unit according to the comparative example.

Moreover, two initialization periods P1 and P2 are provided in this example. However, when more initialization periods are provided, defects in display may increase further. FIG. 15 illustrates an example of an operation in a case where four initialization periods are provided in the display unit 1R according to the comparative example. In this example, the pixel 11($n$) (the defective pixel 11S) in the n-th row influences display operations of four pixels 11($n$−5) to 11($n$−2). In this case, line defects as shown in FIG. 14 occur for four rows. In such a manner, the more the initialization periods are provided, the more defects in display occur.

On the other hand, in the display unit 1 according to the present embodiment, as shown in FIG. 5, etc., the initialization periods P1 and P2 end earlier than the Vth correction periods P3 and P4 in another row in the horizontal period (1H). As a result, as shown in FIG. 10, in the pixel 11($n$−3) according to the display unit 1, the Vth correction operation is allowed to be performed normally after the offset voltage Vofs increases by the voltage ΔV to return to the original voltage in the second Vth correction period P4 immediately before the signal writing period P5. Therefore, it is possible to reduce the possibility of occurrence of line defects as shown in FIG. 14.

In such a manner, in the display unit 1, even when part (for example, 11($n$)) of the pixels 11 includes the point defect, it is possible to suppress its influence on the display operation in another pixel (for example, 11($n$−3)).

[Effects]

As described above, in the present embodiment, the initialization period ends earlier than the Vth correction period in another row. Therefore, even when the pixel includes the point defect, it is possible to suppress its influence on the display operation in another pixel.

[Modification 1-1]

In the above-described embodiment, two initialization periods are provided. However, this is not limitative. For example, three or more initialization periods may be provided, or only one initialization period may be provided. Similarly, in the above-described embodiment, two Vth correction periods are provided. However, this is not limitative. For example, three or more Vth correction periods may be provided, or only one Vth correction period may be provided. An example of the present modification will be described below.

Figure 16:
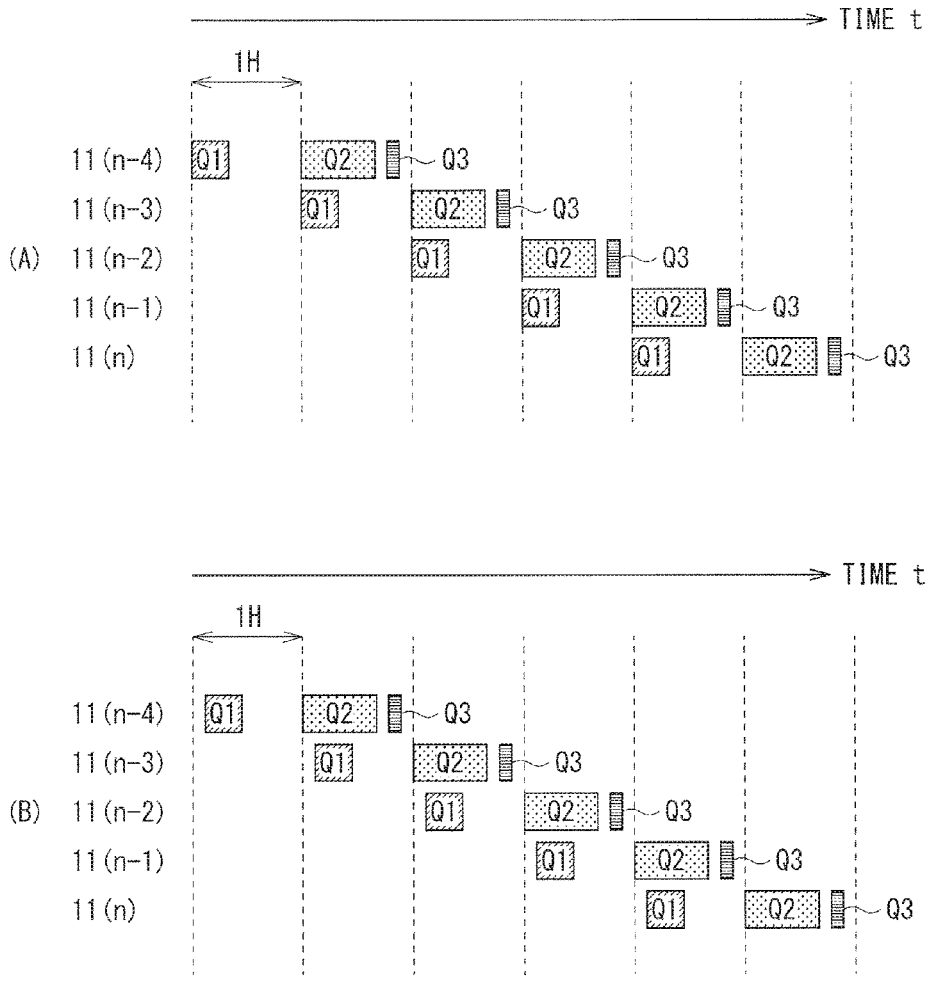
FIG. 16 is a schematic diagram illustrating an operation example of a display unit according to a modification of the first embodiment.

FIG. 16 illustrates an operation example in a case where one initialization period and one Vth correction period are provided. (A) of FIG. 16 shows an example in a case where an initialization period Q1 and a Vth correction period Q2 begin at the same time in the horizontal period (1H). (B) of FIG. 16 shows an example in a case where the initialization period Q1 begins after the Vth correction period Q2 has begun in the horizontal period (1H). Also in these cases, the initialization period Q1 ends earlier than the Vth correction period Q2 in another row. Therefore, as in the case of the above-described embodiment, the Vth correction operation is allowed to be performed normally. Therefore, even when the pixel includes the point defect, it is possible to suppress its influence on the display operation in another pixel.

2. Second Embodiment

Next, description will be given on the display unit 2 according to the second embodiment. In the present embodiment, the initialization period and the Vth correction period in another row are provided in horizontal periods different from each other. It is to be noted that the same symbols are attached to components substantially the same as those in the display 2 according to the above-described first embodiment, and description thereof will be appropriately omitted.

Figure 17:
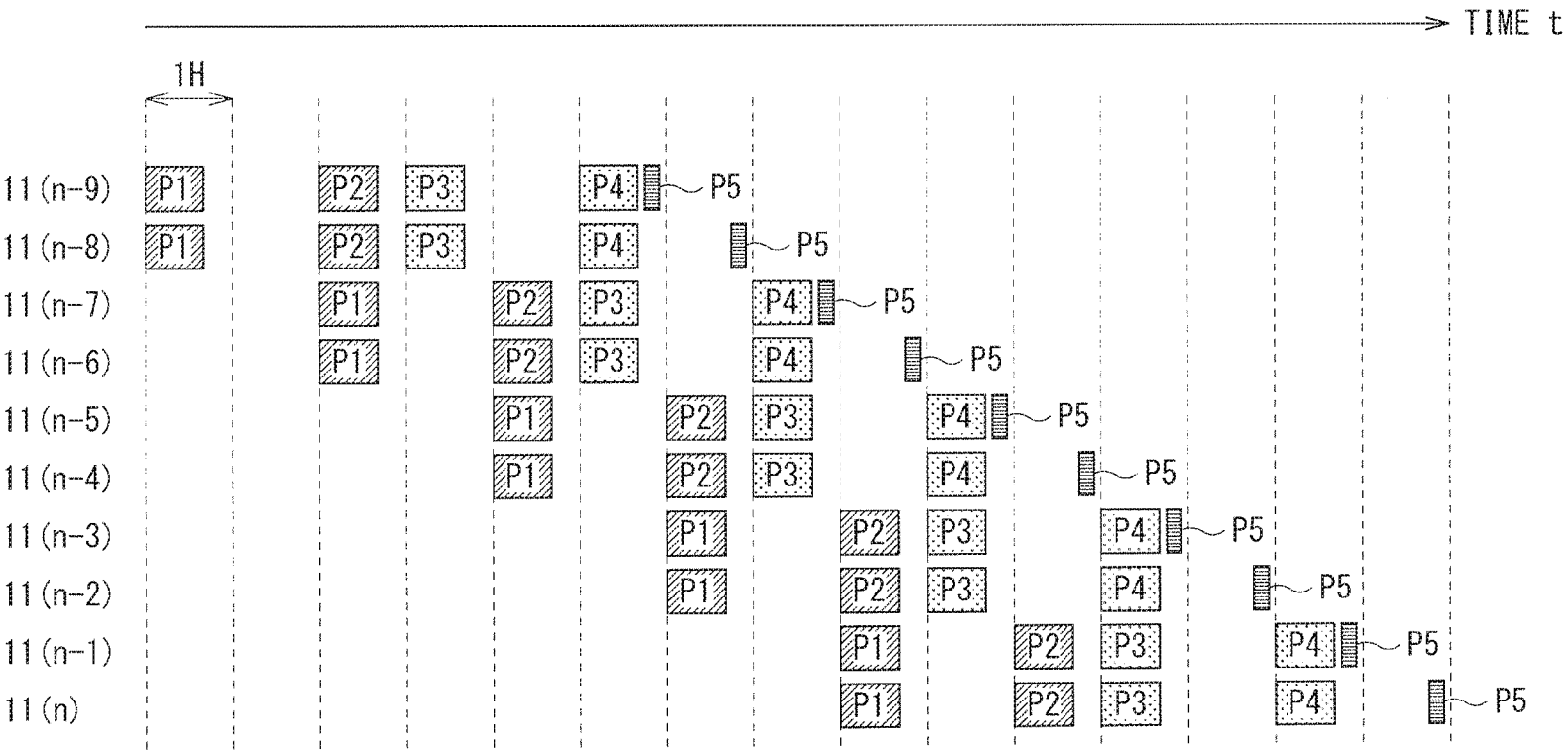
FIG. 17 is a schematic diagram illustrating an operation example of a display unit according to a second embodiment.

FIG. 17 illustrates the operation states of the pixels 11 in the respective rows in the display panel 10 according to the display unit 2, and illustrates the operation states of the respective pixels 11 in ten rows in total from an (n−9)th row to the n-th row.

Each of the pixels 11 in the display unit 2 performs the initialization in first and third horizontal periods out of a period corresponding to six adjacent horizontal period (1H)s (the initialization periods P1 and P2), and performs the Vth correction in fourth and sixth horizontal periods (the Vth correction periods P3 and P4). In this example, a length of each of the initialization periods P1 and P2 is almost the same as a length of each of the Vth correction periods P3 and P4. Further, the pixel signal Vpix is written in each pixel 11 in the horizontal period in which the Vth correction period P4 is provided, or in a horizontal period subsequent to the horizontal period in which the Vth correction period P4 is provided (the signal writing period P5). Thereafter, each pixel 11 emits light based on that pixel signal Vpix. Specifically, as shown in FIG. 17, for example, the signal writing period P5 is provided in the horizontal period in which the Vth correction period P4 is provided for the pixel 11($n$−1), and the signal writing period P5 is provided in a horizontal period subsequent to the horizontal period in which the Vth correction period P4 is provided for the pixel 11($n$).

The display unit 2 performs this series of operations on a two-row basis so as to allow the operations to be shifted by two horizontal periods. Specifically, for example, as shown in FIG. 17, the pixels 11($n$−1) and 11($n$) perform the initialization (the initialization periods P1 and P2) and the Vth correction (the Vth correction periods P3 and P4) in the same horizontal period. Similarly, the pixels 11($n$−3) and 11($n$−2)) perform the initialization (the initialization periods P1 and P2) and the Vth correction (the Vth correction periods P3 and P4) in the same horizontal period. At that time, the pixels 11($n$−3) and 11($n$−2) perform the second initialization operation in the initialization period P2 when the pixels 11($n$−1) and 11($n$) perform the first initialization operation in the initialization period P1, and the pixels 11($n$−3) and 11($n$−2) perform the second Vth correction in the Vth correction period P4 when the pixels 11($n$−1) and 11($n$) perform the first Vth correction in the Vth correction period P3.

Accordingly, in the display unit 2, as shown in FIG. 17, the initialization periods P1 and P2 are arranged in a horizontal period different from the horizontal period of the Vth correction period in another row. In this case, even when part of the pixels 11 includes the point defect, and the offset voltage Vofs is shifted at the time of the initialization operation on that defective pixel 11S (the initialization periods P1 and P2), this shift in the offset voltage Vofs does not influence the Vth correction of another pixel because any other pixel does not perform the Vth correction in this horizontal period. Therefore, in the display unit 2, even when part of the pixels 11 includes the point defect, it is possible to suppress its influence on the display operation in another pixel.

As described above, in the present embodiment, the initialization period is provided in a horizontal period different from that of the Vth correction period in another row. Therefore, even when the pixel includes the point defect, it is possible to suppress its influence on the display operation in another pixel.

[Modification 2-1]

In the above-described embodiment, the signal writing period P5 is provided in the horizontal period in which the Vth correction period P4 is provided, or in the horizontal period subsequent to the horizontal period in which the Vth correction period P4 is provided. However, at that time, the horizontal period in which this signal writing period P5 is provided may be changed for each frame. Details thereof will be described below.

Figure 18:
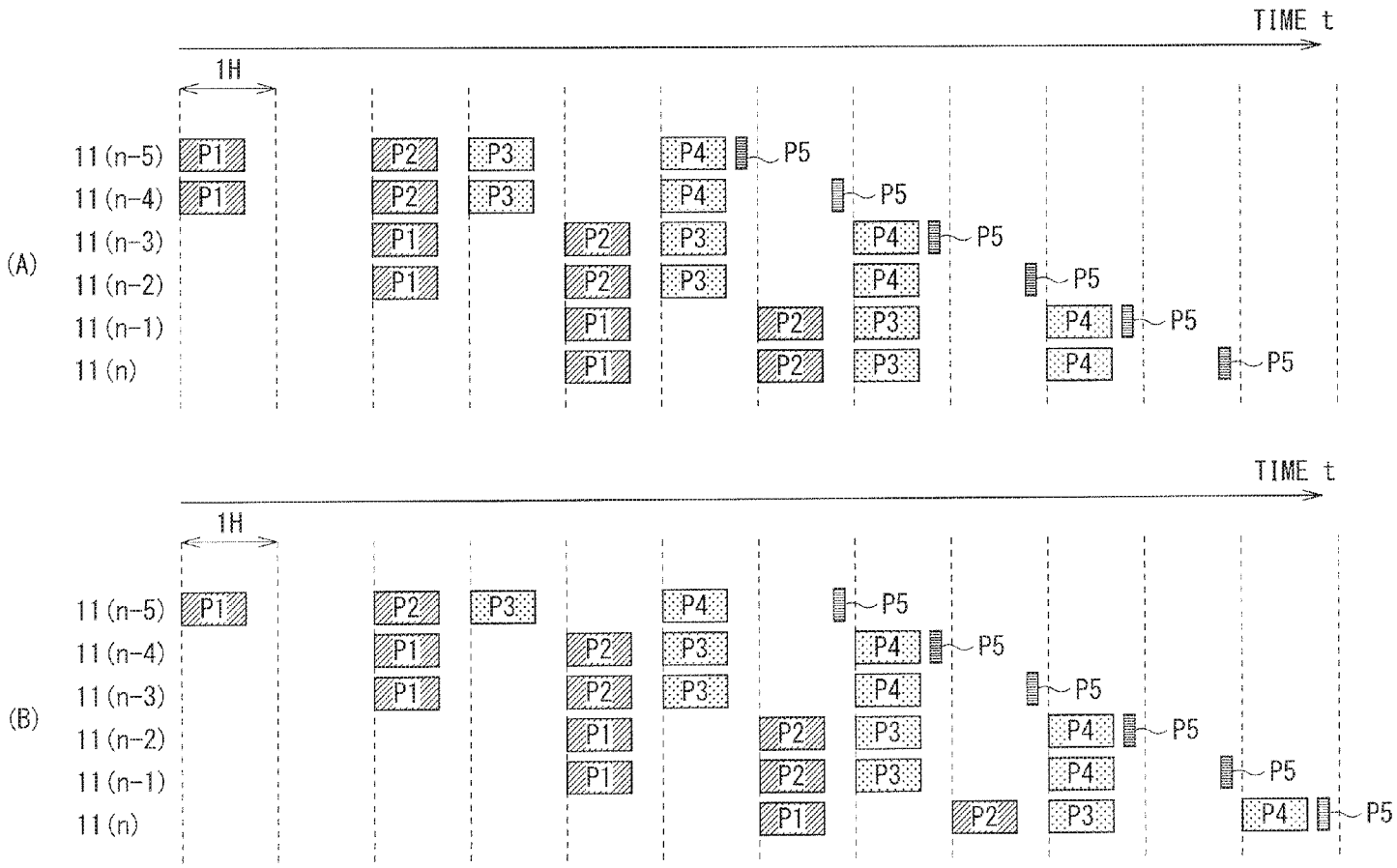
FIG. 18 is a schematic diagram illustrating an operation example of a display unit according to a modification of the second embodiment.

FIG. 18 illustrates the operation states of the pixels 11 in the respective row according to the present modification. (A) shows the operation states in one frame, and (B) shows the operation states in another frame. In the present modification, as shown in FIG. 18, the horizontal period in which the signal writing period P5 is provided is changed for each frame. Specifically, for example, the pixel signal Vpix is written in the pixel 11(*n*) (the signal writing period P5) in the horizontal period subsequent to the horizontal period in which the Vth correction period P4 is provided in (A) of FIG. 18, and the pixel signal Vpix is written in the pixel 11(*n*) (the signal writing period P5) in the horizontal period in which the Vth correction period P4 is provided in (B) of FIG. 18.

In such a manner, in the present modification, the horizontal period in which the signal writing period P5 is provided is changed for each frame. As a result, in the display unit according to the present modification, for example, even when the time from performing the Vth correction in the Vth correction period P4 to writing of the pixel signal Vpix in the signal writing period influences light emission luminance of that pixel, the light emission luminance is averaged by displaying a plurality of frames, and therefore, it is possible to suppress degradation in image quality.

[Modification 2-2]

In the above-described embodiment, two initialization periods are provided. However, this is not limitative. For example, three or more initialization periods may be provided, or only one initialization period may be provided. Similarly, in the above-described embodiment, two Vth correction periods are provided. However, this is not limitative. For example, three or more Vth correction periods may be provided, or only one Vth correction period may be provided. An example of the present modification will be described below.

Figure 19:
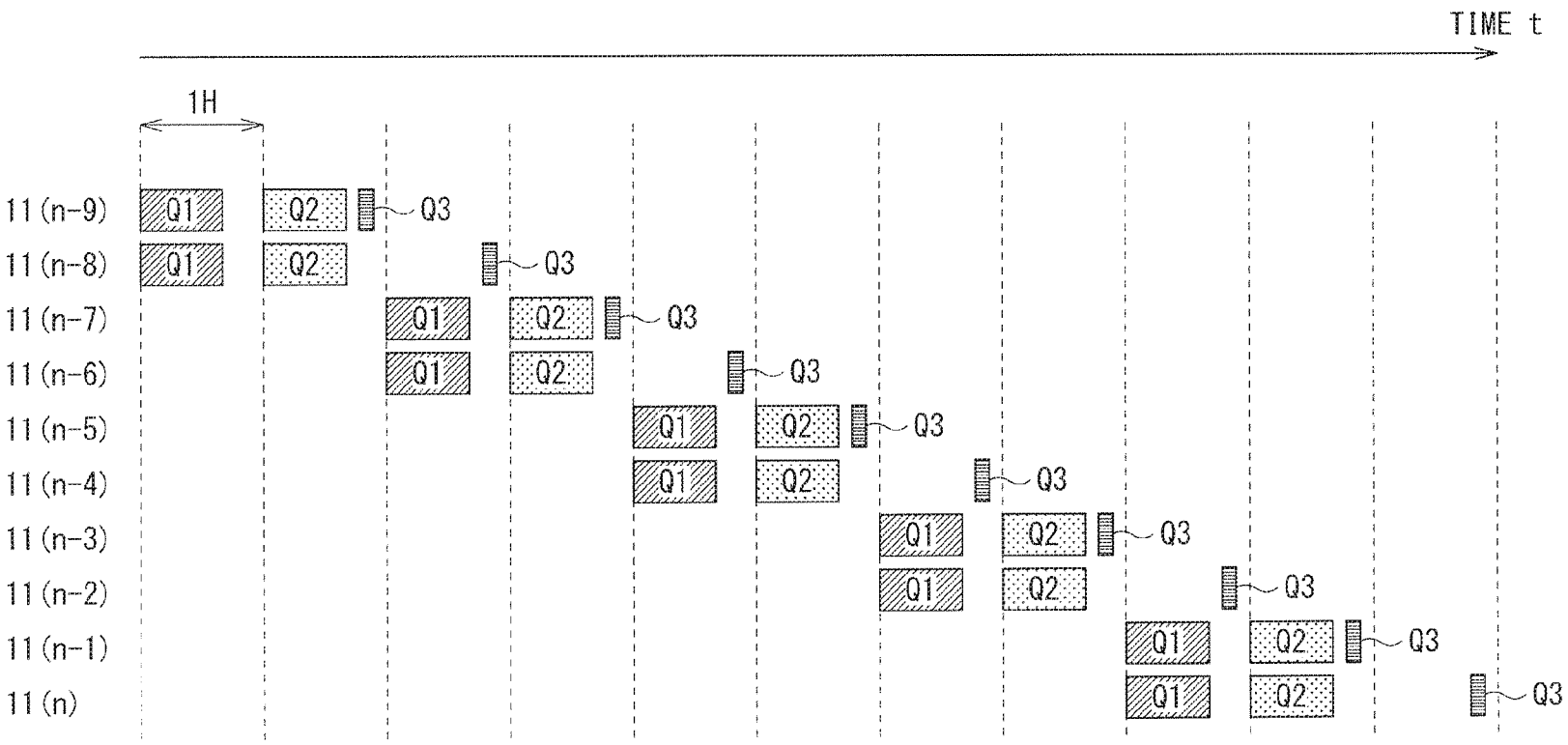
FIG. 19 is a schematic diagram illustrating an operation example of a display unit according to another modification of the second embodiment.

FIG. 19 illustrates an operation example in a case where one initialization period and one Vth correction period are provided. Each pixel 11 according to the present modification performs the initialization in a first horizontal period in a period corresponding to two horizontal period (1H)s (the initialization period Q1), and performs the Vth correction in a last horizontal period (the Vth correction period Q2). Further, the pixel signal Vpix is written in each pixel 11 (a signal writing period Q3) in the horizontal period in which the Vth correction period Q2 is provided, or in a horizontal period subsequent to the horizontal period in which the Vth correction period Q2 is provided. Thereafter, each pixel 11 emits light based on that pixel signal Vpix.

The display unit according to the present modification performs this series of operations on a two-row basis so as to allow the operations to be shifted by two horizontal periods. Specifically, for example, as shown in FIG. 19, the pixels 11(*n*−3) and 11(*n*−2)) perform the initialization (the initialization period Q1) in the same horizontal period, and perform the Vth correction (the Vth correction period Q2) in a subsequent horizontal period. Further, the pixels 11(*n*−1) and 11(*n*) perform the initialization (the initialization period Q1) in a subsequent horizontal period, and performs the Vth correction (the Vth correction period Q2) in another-subsequent horizontal period.

Also in these cases, the initialization period Q1 is provided in a horizontal period different from that of the Vth correction period Q2 of another row. Therefore, as in the above-described embodiment, the Vth correction operation is allowed to be performed normally. Therefore, even when the pixel includes the point defect, it is possible to suppress its influence on the display operation in another pixel.

[Modification 2-3]

Figure 20:
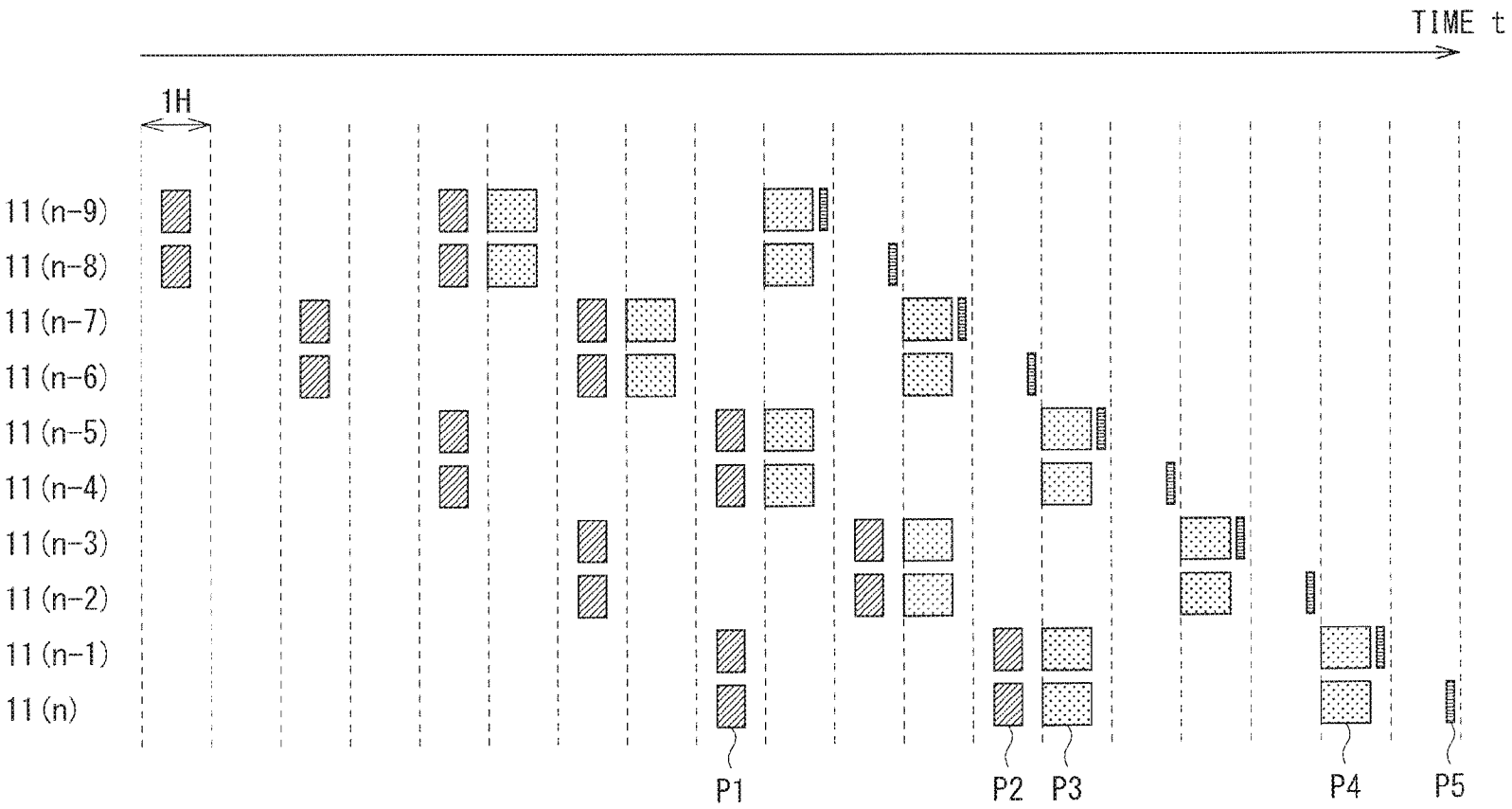
FIG. 20 is a schematic diagram illustrating an operation example of a display unit according to another modification of the second embodiment.

In the above-described embodiment, the initialization periods P1 and P2 are arranged in the first and third horizontal periods in the period corresponding to six adjacent horizontal period (1H)s, and the Vth correction periods P3 and P4 are arranged in the fourth and sixth horizontal periods therein. However, this is not limitative. Also, in the above-described embodiment, the length of each of the initialization periods P1 and P2 is almost the same as the length of each of the Vth correction periods P3 and P4. However, this is not limitative. For example, as shown in FIG. 20, the initialization periods P1 and P2 may be arranged in first and fifth horizontal periods in a period corresponding to ten adjacent horizontal period (1H)s, and the Vth correction periods P3 and P4 are arranged in sixth and tenth horizontal periods therein. Also, the length of each of the initialization periods P1 and P2 may be shorter than the length of each of the Vth correction periods P3 and P4.

3. Application Examples

Next, description will be given on application examples of the display units described in the above embodiments and modifications.

Figure 21:
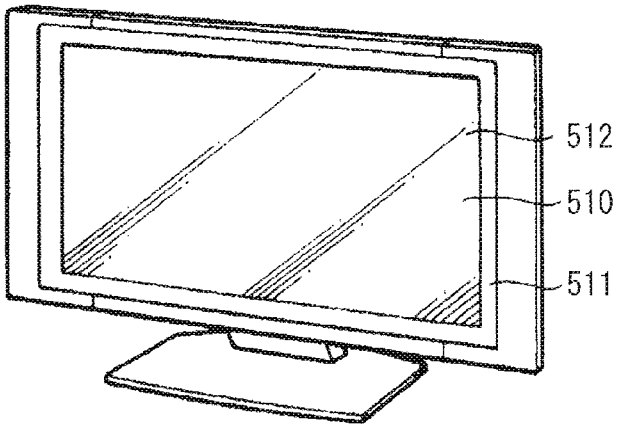
FIG. 21 is a perspective view illustrating an appearance configuration of a television apparatus to which the display unit according to any of the embodiments is applied.

FIG. 21 illustrates an appearance of a television apparatus to which any of the display units according to the above-described embodiments and the like is applied. This television apparatus may include, for example, an image display screen section 510 that includes a front panel 511 and a filter glass 512. This image display screen section 510 is configured of any of the display units according to the above-described embodiments and the like.

The display units according to the above-described embodiments and the like are applicable to electronic apparatuses in any field such as a digital camera, a notebook personal computer, a mobile terminal apparatus such as a mobile phone, a mobile game machine, and a video camcorder, other than the television apparatus as described above. In other words, the display units according to the above-described embodiments and the like are applicable to electronic apparatuses in any field that display an image.

The present technology has been described above referring to some modifications. However, the present technology is not limited to these embodiments and the like, and various modifications may be made.

Figure 22:
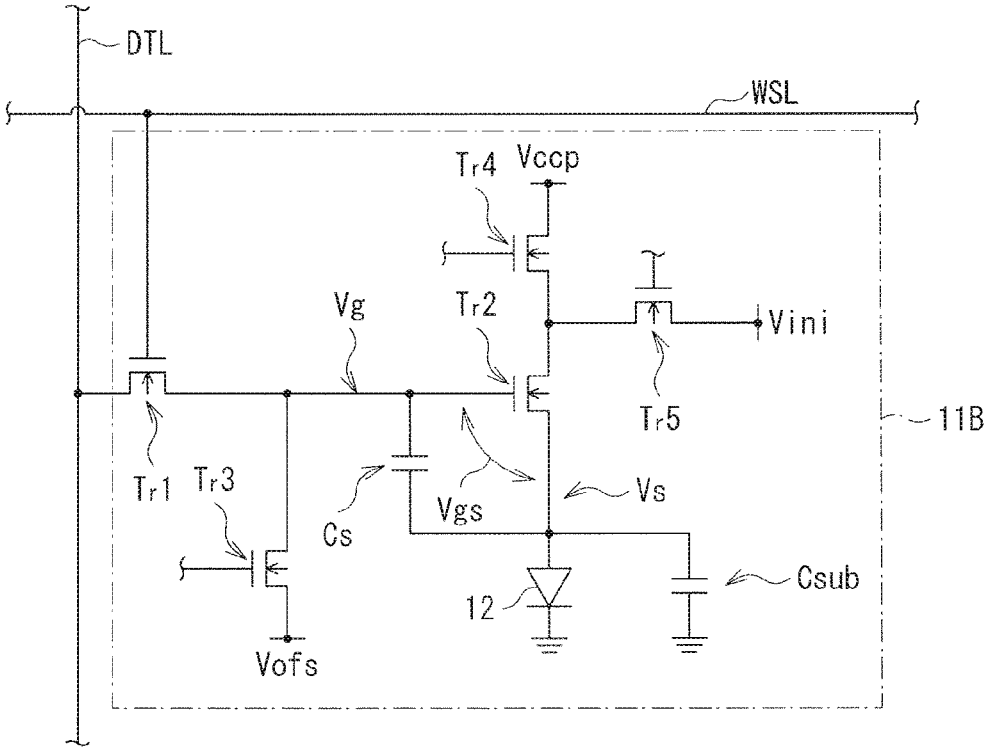
FIG. 22 is a circuit diagram illustrating a configuration example of a pixel according to a modification.

For example, in each of the above-described embodiments, the pixel 11 has the configuration of a so-called "2Tr1C" configured using the writing transistor Tr1, the driving transistor Tr2, and the capacitor Cs. However, this is not limitative. Alternatively, for example, as shown in FIG. 22, a configuration of a so-called "5Tr1C" may be adopted that is configured further using transistors Tr3 to Tr5. The transistor Tr3 is for supplying the offset voltage Vofs to the gate of the driving transistor Tr2. Specifically, although the offset voltage Vofs is supplied to the gate of the driving transistor Tr2 via the writing transistor Tr1 in the above-described embodiments, the offset voltage Vofs is supplied to the gate of the driving transistor Tr2 via the transistor Tr3 in the present modification. The transistor Tr4 is for supplying the voltage Vccp to the drain of the driving transistor Tr2. The transistor Tr5 is for supplying the voltage Vini to the drain of the driving transistor Tr2. Specifically, although the power line drive circuit 25 supplies the power line signal DS including the voltage Vccp and the voltage Vini to the drain of the transistor Tr2 via the power line DSL in the above-described embodiments, the voltage Vccp is supplied to the drain of the driving transistor Tr2 via the transistor Tr4 and the voltage Vini is supplied to the drain of the driving transistor Tr2 via the transistor Tr5 in the present modification.

For example, the organic EL device is used as the display device in each of the above-described embodiments. However, this is not limitative. Alternatively, for example, an inorganic EL device may be used.

It is to be noted that the present technology may have configurations as described below.

(1) A drive circuit including a drive section driving a plurality of pixel circuits by line-sequential scanning, on a plurality of the pixel circuits belonging to one horizontal line, the drive section performing a first preparation drive based on a first voltage in a first preparation period, then performing a second preparation drive based on the first voltage in a second preparation period, and performing writing of luminance information in a subsequent writing period, and the second preparation period ending at a timing out of the first preparation periods of other horizontal lines.

(2) The drive circuit according to the above-described (1), wherein the first preparation period and the second preparation period in each of the pixel circuits belong to horizontal periods different from each other.

(3) The drive circuit according to the above-described (2), wherein the second preparation period of the one horizontal line and the first preparation period of one of the other horizontal lines belong to same horizontal period, and, in each horizontal period, the first preparation period of one of the other horizontal lines ends earlier than the second preparation period of the one horizontal line.

(4) The drive circuit according to the above-described (3), wherein the first preparation period of one of the other horizontal lines is shorter than the second preparation period of the one horizontal line.

(5) The drive circuit according to the above-described (2), wherein the first preparation period of the one horizontal line and the second preparation period of each of the other horizontal lines belong to horizontal periods different from each other.

(6) The drive circuit according to the above-described (5), wherein the first preparation period has a length same as a length of the second preparation period.

(7) The drive circuit according to any one of the above-described (1) to (6), wherein a plurality of the second preparation periods are provided for each of the pixel circuits, the plurality of second preparation periods belong to horizontal periods different from one another, and a last period of the plurality of second preparation periods ends at a timing out of the first preparation periods of the other horizontal lines.

(8) The drive circuit according to any one of the above-described (1) to (7), wherein a plurality of the first preparation periods are provided for each of the pixel circuits.

(9) The drive circuit according to any one of the above-described (1) to (8), wherein the pixel circuits each includes a light emitting device, a transistor, and a capacitor, the transistor having a source that is connected to the light emitting device, and the capacitor being inserted between a gate and the source of the transistor, the drive section applies the first voltage to the gate of the transistor and applies a second voltage to a drain of the transistor in the first preparation period, the second voltage being lower than the first voltage, and the drive section applies the first voltage to the gate of the transistor and applies a third voltage to the drain of the transistor in the second preparation period, the third voltage being higher than the first voltage.

(10) The drive circuit according to the above-described (9), wherein the light emitting device is an electroluminescence device.

(11) A driving method including:

at a time of driving a plurality of pixel circuits by line-sequential driving, on a plurality of the pixel circuits belonging to one horizontal line, performing a first preparation drive based on a first voltage in a first preparation period;

then performing a second preparation drive based on the first voltage in a second preparation period, the second preparation period ending at a timing out of the first preparation periods of other horizontal lines; and performing writing of luminance information in a subsequent writing period.

(12) A display unit including:

a plurality of pixel circuits; and a drive section driving the plurality of pixel circuits by line-sequential scanning, on a plurality of the pixel circuits belonging to one horizontal line, the drive section performing a first preparation drive based on a first voltage in a first preparation period, then performing a second preparation drive based on the first voltage in a second preparation period, and performing writing of luminance information in a subsequent writing period, and the second preparation period ending at a timing out of the first preparation periods of other horizontal lines.

(13) An electronic apparatus including:

a display unit; and a control circuit performing operation control utilizing the display unit, the display unit including a plurality of pixel circuits, and a drive section driving the plurality of pixel circuits by line-sequential scanning, on a plurality of the pixel circuits belonging to one horizontal line, the drive section performing a first preparation drive based on a first voltage in a first preparation period, then performing a second preparation drive based on the first voltage in a second preparation period, and performing writing of luminance information in a subsequent writing period, and the second preparation period ending at a timing out of the first preparation periods of other horizontal lines.

This application claims priority on the basis of Japanese Patent Application JP 2011-235045 filed Oct. 26, 2011 in Japan Patent Office, the entire contents of each which are incorporated herein by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. A drive circuit comprising a drive section configured to drive a plurality of pixel circuits by line-sequential scanning, wherein on a first group of the plurality of pixel circuits belonging to a first horizontal line, the drive section is configured to perform a first preparation drive based on a first voltage in a first preparation period of the first horizontal line, then to perform a second preparation drive based on the first voltage in a second preparation period of the first horizontal line, and to perform writing of luminance information in a subsequent writing period, on a second group of the plurality of pixel circuits belonging to a second horizontal line, the drive section is configured to perform the first preparation drive based on the first voltage in a first preparation period of the second horizontal line, then to perform the second preparation drive based on the first voltage in a second preparation period of the second horizontal line, and the second preparation period of the first horizontal line begins at a first time when the first preparation period of the second horizontal line begins, and ends at a second time after the first preparation period of the second horizontal line ends.

2. The drive circuit according to claim 1, wherein the first preparation period and the second preparation period in respective ones of the plurality of pixel circuits belong to horizontal periods different from each other.

3. The drive circuit according to claim 2, wherein the second preparation period of the first horizontal line and the first preparation period of the second horizontal line belong to same horizontal period, and, in each horizontal period, the first preparation period of the second horizontal line ends earlier than the second preparation period of the first horizontal line.

4. The drive circuit according to claim 3, wherein the first preparation period of the second horizontal line is shorter than the second preparation period of the first horizontal line.

5. The drive circuit according to claim 2, wherein the first preparation period of the first horizontal line and the second preparation period of the second horizontal line belong to horizontal periods different from each other.

6. The drive circuit according to claim 5, wherein the first preparation period has a length same as a length of the second preparation period.

7. The drive circuit according to claim 1, wherein a plurality of the second preparation periods are provided for respective ones of the plurality of pixel circuits, the plurality of second preparation periods belong to horizontal periods different from one another, and a last period of the plurality of second preparation periods ends at a timing out of the first preparation periods of the respective second horizontal lines.

8. The drive circuit according to claim 1, wherein a plurality of the first preparation periods are provided for each of the pixel circuits.

9. The drive circuit according to claim 1, wherein the pixel circuits respectively include a light emitting device, a transistor, and a capacitor, the transistor having a source that is connected to the light emitting device, and the capacitor being disposed between a gate and the source of the transistor, the drive section is configured to apply the first voltage to the gate of the transistor and to apply a second voltage to a drain of the transistor in the first preparation period, the second voltage being lower than the first voltage, and the drive section is configured to apply the first voltage to the gate of the transistor and to apply a third voltage to the drain of the transistor in the second preparation period, the third voltage being higher than the first voltage.

10. The drive circuit according to claim 9, wherein the light emitting device is an electroluminescence device.

11. The drive circuit according to claim 1, wherein the first preparation period of the first horizontal line includes a first initialization period and a second initialization period separated in time, the first and second initialization periods being periods in which the plurality of pixel circuits are initialized.

12. The drive circuit according to claim 1, wherein the second preparation period of the first horizontal line includes a first threshold correction period and a second threshold correction period separated in time, the first and second threshold correction periods being periods in which a threshold voltage of a driving transistor of the plurality of pixel circuits is corrected.

13. A driving method comprising:

at a time of driving a plurality of pixel circuits by line-sequential driving, on a first group of the plurality of pixel circuits belonging to a first horizontal line, performing a first preparation drive based on a first voltage in a first preparation period of the first horizontal line;

then performing a second preparation drive based on the first voltage in a second preparation period of the first horizontal line, and performing writing of luminance information in a subsequent writing period, on a second group of the plurality of pixel circuits belonging to a second horizontal line, performing the first preparation drive based on the first voltage in a first preparation period of the second horizontal line; and then performing the second preparation drive based on the first voltage in a second preparation period of the second horizontal line, wherein the second preparation period of the first horizontal line begins at a first time when the first preparation period of the second horizontal line begins, and ends at a second time after the first preparation period of the second horizontal line ends.

14. A display unit comprising:

a plurality of pixel circuits; and a drive section configured to drive the plurality of pixel circuits by line-sequential scanning, wherein on a first group of the plurality of pixel circuits belonging to a first horizontal line, the drive section is configured to perform a first preparation drive based on a first voltage in a first preparation period of the first horizontal line, then to perform a second preparation drive based on the first voltage in a second preparation period of the first horizontal line, and to perform writing of luminance information in a subsequent writing period, on a second group of the plurality of pixel circuits belonging to a second horizontal line, the drive section is configured to perform the first preparation drive based on the first voltage in a first preparation period of the second horizontal line, then to perform the second preparation drive based on the first voltage in a second preparation period of the second horizontal line, and the second preparation period of the first horizontal line begins at a first time when the first preparation period of the second horizontal line begins, and ends at a second time after the first preparation period of the second horizontal line ends.

15. An electronic apparatus comprising:

a display unit; and a control circuit configured to perform operation control utilizing the display unit, the display unit including a plurality of pixel circuits, and a drive section configured to drive the plurality of pixel circuits by line-sequential scanning, wherein on a first group of the plurality of pixel circuits belonging to a first horizontal line, the drive section is configured to perform a first preparation drive based on a first voltage in a first preparation period of the first horizontal line, then to perform a second preparation drive based on the first voltage in a second preparation period of the first horizontal line, and to perform writing of luminance information in a subsequent writing period, on a second group of the plurality of pixel circuits belonging to a second horizontal line, the drive section is configured to perform the first preparation drive based on the first voltage in a first preparation period of the second horizontal line, then to perform the second preparation drive based on the first voltage in a second preparation period of the second horizontal line, and the second preparation period of the first horizontal line begins at a first time when the first preparation period of the second horizontal line begins, and ends at a second time after the first preparation period of the second horizontal line ends.

* * * * *